US007295198B2

(12) United States Patent
Nishimura

(10) Patent No.: US 7,295,198 B2
(45) Date of Patent: Nov. 13, 2007

(54) VOLTAGE BOOSTER CIRCUIT, POWER SUPPLY CIRCUIT, AND LIQUID CRYSTAL DRIVER

(75) Inventor: Motoaki Nishimura, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 499 days.

(21) Appl. No.: 11/024,713

(22) Filed: Dec. 30, 2004

(65) Prior Publication Data

US 2005/0156923 A1 Jul. 21, 2005

(30) Foreign Application Priority Data

Jan. 15, 2004 (JP) ..... 2004-008226

(51) Int. Cl.
*G09G 5/00* (2006.01)

(52) U.S. Cl. ..... 345/211; 345/213; 257/299; 327/148

(58) Field of Classification Search ..... 345/211, 345/213; 257/299; 327/148
See application file for complete search history.

(56) References Cited

U.S. PATENT DOCUMENTS

2005/0156924 A1 7/2005 Nishimura

FOREIGN PATENT DOCUMENTS

JP A 2000-262045 9/2000
JP A 2004-180364 6/2004

*Primary Examiner*—Sumati Lefkowitz
*Assistant Examiner*—Ke Xiao
(74) *Attorney, Agent, or Firm*—Oliff & Berridge, PLC

(57) ABSTRACT

A charge-pump circuit includes: MOS transistors connected in series and having one end to which a system ground power supply voltage is supplied; and a discharge transistor. The discharge transistor has one end connected to a node which is connected to the MOS transistors, and the system ground power supply voltage is supplied to the other end of the discharge transistor. The MOS transistors are implemented by a triple-well structure formed in a p-type semiconductor substrate. When a normal operation is performed, the MOS transistors are turned ON and the discharge transistor is turned OFF. When a discharge operation is performed, the MOS transistors are turned OFF and the discharge transistor is turned ON, and a current path is formed by parasitic bipolar transistor elements.

16 Claims, 18 Drawing Sheets

| | NORMAL OPERATION | DISCHARGE OPERATION |
|---|---|---|
| NSW5 | CONDUCTIVE | NONCONDUCTIVE |
| DSW1,DSW2 | NONCONDUCTIVE | CONDUCTIVE |

VOLTAGE BOOSTER CIRCUIT, POWER SUPPLY CIRCUIT, AND LIQUID CRYSTAL DRIVER

Japanese Patent Application No. 2004-8226, filed on Jan. 15, 2004, is hereby incorporated by reference in its entirety.

BACKGROUND OF THE INVENTION

The present invention relates to a voltage booster circuit, a power supply circuit, and a liquid crystal driver.

A reduction of power consumption has been increasingly demanded for a portable electronic instrument. A liquid crystal device is generally used as a display device provided in such an electronic instrument, for example.

A high voltage is necessary for driving the liquid crystal device. Therefore, it is preferable from the viewpoint of cost that a liquid crystal driver which drives the liquid crystal device include a power supply circuit which generates a high voltage. In this case, the power supply circuit includes a voltage booster circuit. Power consumption can be reduced by using a charge-pump circuit which generates a voltage boosted by a charge-pump operation as the voltage booster circuit.

The charge-pump circuit (voltage booster circuit in a broad sense) connects one end of a capacitor which stores an electric charge with various voltages using a switch element (metal oxide semiconductor (MOS) transistor, for example), thereby boosting the voltage corresponding to the electric charge stored in the capacitor. Therefore, the electric charge stored in the capacitor during the operation is maintained even if the operation of the charge-pump circuit is terminated.

A liquid crystal which makes up a pixel of the liquid crystal device deteriorates when a DC component voltage is applied to the liquid crystal. Therefore, when terminating the operation of the charge-pump circuit which generates the voltage for the liquid crystal device, the voltage applied to the liquid crystal must be controlled by performing a discharge operation according to a predetermined sequence.

However, when the operation of the charge-pump circuit which generates the voltage for the liquid crystal device is terminated, voltage is applied to the liquid crystal due to the electric charge stored in the capacitor. In a simple matrix liquid crystal device (passive matrix type liquid crystal device) in particular, voltage between a COM electrode and an SEG electrode is directly applied to the liquid crystal. Therefore, the electric charge stored in the capacitor must be discharged when terminating the operation of the charge-pump circuit. Moreover, if the electric charge stored in the capacitor cannot be discharged at high speed, a period of time required until the completion of the sequence is increased. This poses inconvenience to the user who repeatedly performs power-on and power-off operations.

BRIEF SUMMARY OF THE INVENTION

According to a first aspect of the present invention, there is provided a voltage booster circuit which uses an electric charge stored in a capacitor by a charge-pump operation to generate a boost voltage, the voltage booster circuit comprising:

first to Nth transistors (N is an integer greater than one) which are connected in series and used for the charge-pump operation, a first voltage being supplied to one end of the first transistor; and a discharge transistor having one end connected to a node which is connected to (k−1)th and kth transistors among the first to Nth transistors ($2 \leqq k \leqq N$, and k is an integer), the first voltage or a second voltage which is higher than the first voltage being supplied to the other end of the discharge transistor, wherein the first to Nth transistors are respectively formed in p-type first to Nth well regions provided in an n-type well region of a p-type semiconductor substrate;

wherein a reverse bias voltage for the p-type first to Nth well regions is applied to the n-type well region;

wherein each of the p-type first to Nth well regions includes an n-type source region and an n-type drain region;

wherein a gate electrode of each of the p-type first to Nth transistors is disposed in a channel region with an insulating film interposed, the channel region being disposed between the n-type source region and the n-type drain region;

wherein the first voltage is supplied to the n-type drain region of the p-type first well region, the n-type source region of a p-type (m−1)th well region among the p-type first to Nth well regions ($2 \leqq m \leqq N$, and m is an integer) is electrically connected to the n-type drain region of the p-type mth well region, and a voltage of the n-type source region of the p-type Nth well region is output as the boost voltage;

wherein, when a normal operation is performed, the kth to Nth transistors are made conductive, the discharge transistor is made nonconductive and the boost voltage is generated by the charge-pump operation using the first to (k−1)th transistors; and wherein, when a discharge operation is performed, the kth to Nth transistors are made nonconductive, the discharge transistor is made conductive and a current path is formed by first to (k−1)th parasitic bipolar transistor elements, the first to (k−1)th parasitic bipolar transistor elements being respectively formed by one of the p-type first to (k−1)th well regions, the n-type drain region of one of the p-type first to (k−1)th well regions, and the n-type well region.

According to a second aspect of the present invention, there is provided a voltage booster circuit which uses an electric charge stored in a capacitor by a charge-pump operation to generate a boost voltage, the voltage booster circuit comprising:

first to Nth transistors (N is an integer greater than one) which are connected in series and used for the charge-pump operation, a first voltage being supplied to one end of the first transistor; and a discharge transistor having one end connected to a node which is connected to (k−1)th and kth transistors among the first to Nth transistors ($2 \leqq k \leqq N$, and k is an integer), the first voltage or a second voltage which is lower than the first voltage being supplied to the other end of the discharge transistor, wherein the first to Nth transistors are respectively formed in n-type first to Nth well regions provided in a p-type well region of an n-type semiconductor substrate;

wherein a reverse bias voltage for the n-type first to Nth well regions is applied to the p-type well region;

wherein each of the n-type first to Nth well regions includes a p-type source region and a p-type drain region;

wherein a gate electrode of each of the n-type first to Nth transistors is disposed in a channel region with an insulating film interposed, the channel region being disposed between the p-type source region and the p-type drain region;

wherein the first voltage is supplied to the p-type drain region of the n-type first well region, the p-type source region of an n-type (m−1)th well region among the n-type first to Nth well regions (2≦m≦N, and m is an integer) is electrically connected to the p-type drain region of the n-type mth well region, and a voltage of the p-type source region of the n-type Nth well region is output as the boost voltage;

wherein, when a normal operation is performed, the kth to Nth transistors are made conductive, the discharge transistor is made nonconductive and the boost voltage is generated by the charge-pump operation using the first to (k−1)th transistors; and wherein, when a discharge operation is performed, the kth to Nth transistors are made nonconductive, the discharge transistor is made conductive and a current path is formed by first to (k−1)th parasitic bipolar transistor elements, the first to (k−1)th parasitic bipolar transistor elements being respectively formed by one of the n-type first to (k−1)th well regions, the p-type drain region of one of the n-type first to (k−1)th well regions, and the p-type well region.

According to a third aspect of the present invention, there is provided a power supply circuit, comprising:

any of the above-described voltage booster circuits; and a voltage polarity reversal circuit which reverses the polarity of the boost voltage based on a voltage between the first voltage and the second voltage.

According to a fourth aspect of the present invention, there is provided a liquid crystal driver, comprising:

the above-described power supply circuit; and a driver circuit which drives a segment electrode or a common electrode of a simple matrix liquid crystal panel by using at least one of the first voltage, the reverse bias voltage and the boost voltage.

DETAILED DESCRIPTION OF THE EMBODIMENTS

Figure 1:
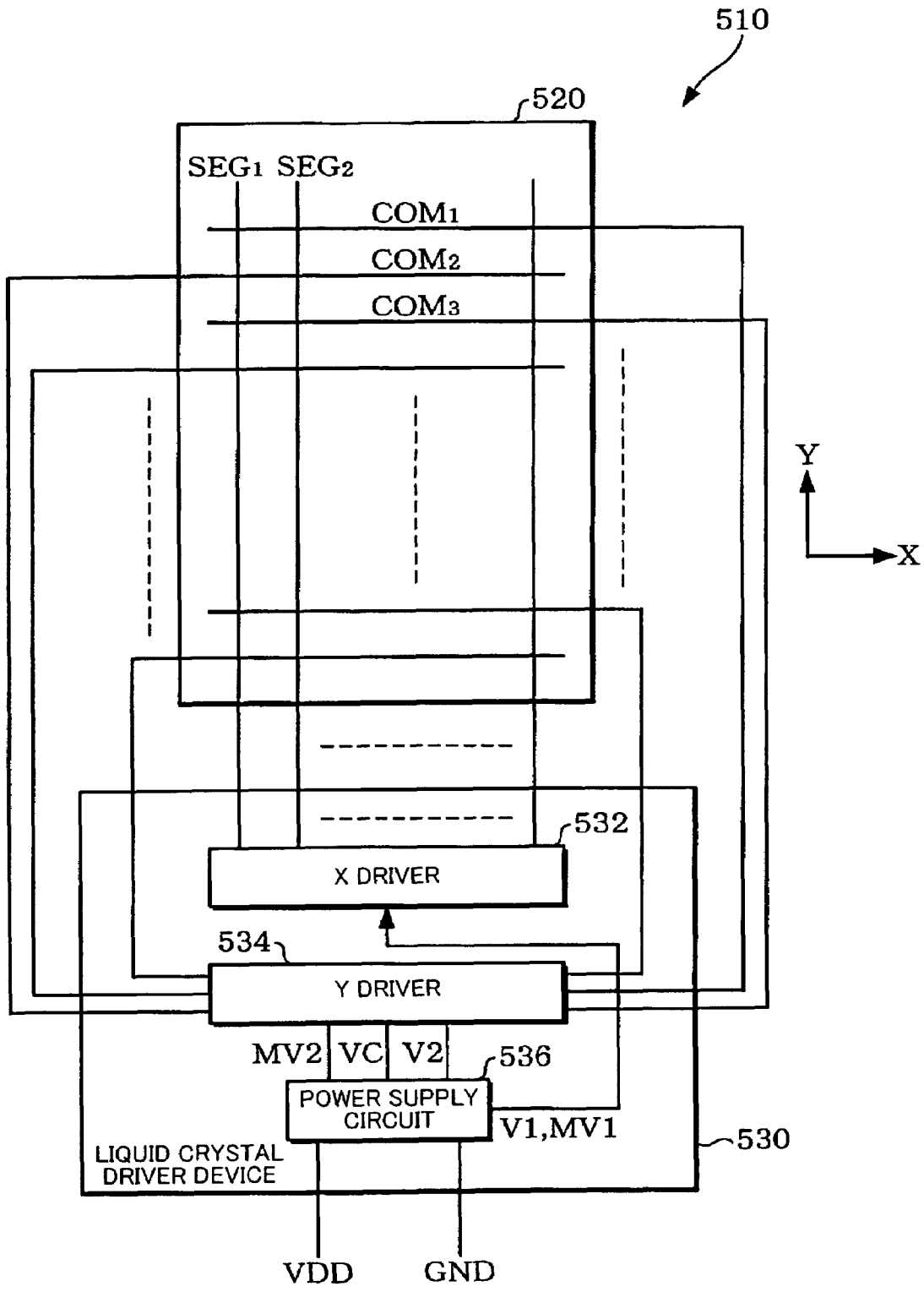
FIG. 1 is a block diagram showing a liquid crystal device including a liquid crystal driver according to one embodiment of the present invention.

The present invention has been achieved in view of the above-described technical problems, and following embodiments of the invention may provide a voltage booster circuit, a power supply circuit, and a liquid crystal driver enabling to discharge an electric charge stored in a capacitor for the charge-pump operation at high speed with simple configuration.

According to one embodiment of the present invention, there is provided a voltage booster circuit which uses an electric charge stored in a capacitor by a charge-pump operation to generate a boost voltage, the voltage booster circuit comprising:

first to Nth transistors (N is an integer greater than one) which are connected in series and used for the charge-pump operation, a first voltage being supplied to one end of the first transistor; and a discharge transistor having one end connected to a node which is connected to (k−1)th and kth transistors among the first to Nth transistors (2≦k≦N, and k is an integer), the first voltage or a second voltage which is higher than the first voltage being supplied to the other end of the discharge transistor, wherein the first to Nth transistors are respectively formed in p-type first to Nth well regions provided in an n-type well region of a p-type semiconductor substrate;

wherein a reverse bias voltage for the p-type first to Nth well regions is applied to the n-type well region;

wherein each of the p-type first to Nth well regions includes an n-type source region and an n-type drain region;

wherein a gate electrode of each of the p-type first to Nth transistors is disposed in a channel region with an insulating film interposed, the channel region being disposed between the n-type source region and the n-type drain region;

wherein the first voltage is supplied to the n-type drain region of the p-type first well region, the n-type source region of a p-type (m−1)th well region among the p-type first to Nth well regions (2≦m≦N, and m is an integer) is electrically connected to the n-type drain region of the p-type mth well region, and a voltage of the n-type source region of the p-type Nth well region is output as the boost voltage;

wherein, when a normal operation is performed, the kth to Nth transistors are made conductive, the discharge transistor is made nonconductive and the boost voltage is generated by the charge-pump operation using the first to (k−1)th transistors; and wherein, when a discharge operation is performed, the kth to Nth transistors are made nonconductive, the discharge transistor is made conductive and a current path is formed by first to (k−1)th parasitic bipolar transistor elements, the first to (k−1)th parasitic bipolar transistor elements being respectively formed by one of the p-type first to (k−1)th well regions, the n-type drain region of one of the p-type first to (k−1)th well regions, and the n-type well region.

In this voltage booster circuit, the first transistor may have one end to which the first voltage is supplied, and apply the first voltage to one end of a first capacitor in a first period, the other end of the first capacitor having the second voltage in the first period and having the first voltage in a second period;

the ith transistor ($2 \leqq i \leqq N$, N is an integer greater than two and i is an even number) may have one end connected to one end of an (i−1)th transistor, and connect one end of an ith capacitor to one end of an (i−1)th capacitor in the second period, the other end of the ith capacitor having the first voltage in the first period and having the second voltage in the second period; and the jth transistor ($3 \leqq j \leqq N$, and j is an odd number) may have one end connected to one end of a (j−1)th transistor, and connect one end of a jth capacitor to one end of the (j−1)th capacitor in the first period, the other end of the jth capacitor having the second voltage in the first period and having the first voltage in the second period.

In this embodiment, by charge-pump operation using the first to Nth transistors implemented by a triple-well structure and capacitors connected to these transistors, a boost voltage obtained by boosting a voltage between the first and second voltages N times, for example, can be output. If the kth to Nth transistors among the first to Nth transistors are fixed to a conducting state, by the charge-pump operation using the first to (k−1)th transistors and capacitors connected to these transistors, a boost voltage obtained by boosting a voltage between the first and second voltages (k−1) times, for example, can be output. In the discharge operation for discharging an electric charge stored in the capacitor, if the kth to Nth transistors are made nonconductive and the first voltage or a voltage higher than the first voltage is applied to a connection node of the (k−1)th and kth transistors through a discharge transistor connected to the connection node, parasitic bipolar transistor elements are turned ON, whereby a current path is formed by the Darlington-connected parasitic bipolar transistor elements. This enables to discharge an electric charge stored in capacitors for the charge-pump operation at high speed with only one discharge transistor, without providing discharge transistors respectively connected to the capacitors, for example.

In particular, since the parasitic bipolar transistor elements are npn-type in this embodiment, current amplification factor is greater than the pnp-type parasitic bipolar transistor elements, whereby an electric charge can be discharged at a higher speed.

In the voltage booster circuit, the reverse bias voltage may be the highest voltage used in the voltage booster circuit.

In this embodiment, latchup can be reliably prevented during the normal operation, and high-speed discharging can be implemented during the discharge operation by only one discharge transistor.

According to one embodiment of the present invention, there is provided a voltage booster circuit which uses an electric charge stored in a capacitor by a charge-pump operation to generate a boost voltage, the voltage booster circuit comprising:

first to Nth transistors (N is an integer greater than one) which are connected in series and used for the charge-pump operation, a first voltage being supplied to one end of the first transistor; and a discharge transistor having one end connected to a node which is connected to (k−1)th and kth transistors among the first to Nth transistors ($2 \leqq k \leqq N$, and k is an integer), the first voltage or a second voltage which is lower than the first voltage being supplied to the other end of the discharge transistor, wherein the first to Nth transistors are respectively formed in n-type first to Nth well regions provided in a p-type well region of an n-type semiconductor substrate;

wherein a reverse bias voltage for the n-type first to Nth well regions is applied to the p-type well region;

wherein each of the n-type first to Nth well regions includes a p-type source region and a p-type drain region;

wherein a gate electrode of each of the n-type first to Nth transistors is disposed in a channel region with an insulating film interposed, the channel region being disposed between the p-type source region and the p-type drain region;

wherein the first voltage is supplied to the p-type drain region of the n-type first well region, the p-type source region of an n-type (m−1)th well region among the n-type first to Nth well regions ($2 \leqq m \leqq N$, and m is an integer) is electrically connected to the p-type drain region of the n-type mth well region, and a voltage of the p-type source region of the n-type Nth well region is output as the boost voltage;

wherein, when a normal operation is performed, the kth to Nth transistors are made conductive, the discharge transistor is made nonconductive and the boost voltage is generated by the charge-pump operation using the first to (k−1)th transistors; and wherein, when a discharge operation is performed, the kth to Nth transistors are made nonconductive, the discharge transistor is made conductive and a current path is formed by first to (k−1)th parasitic bipolar transistor elements, the first to (k−1)th parasitic bipolar transistor elements being respectively formed by one of the n-type first to (k−1)th well regions, the p-type drain region of one of the n-type first to (k−1)th well regions, and the p-type well region.

In this embodiment, by charge-pump operation using the first to Nth transistors implemented by a triple-well structure and capacitors connected to these transistors, a boost voltage obtained by boosting a voltage between the first and second voltages N times, for example, can be output. If the kth to Nth transistors among the first to Nth transistors are fixed to a conducting state, by the charge-pump operation using the first to (k−1)th transistors and capacitors connected to these transistors, a boost voltage obtained by boosting a voltage between the first and second voltages (k−1) times, for example, can be output. In the discharge operation for discharging an electric charge stored in the capacitor, if the kth to Nth transistors are made nonconductive and the first voltage or a voltage higher than the first voltage is applied to a connection node of the (k−1)th and kth transistors through a discharge transistor connected to the connection node, parasitic bipolar transistor elements are turned ON, whereby a current path is formed by the Darlington-connected parasitic bipolar transistor elements. This enables to discharge an electric charge stored in capacitors for the charge-pump operation at high speed with only one discharge transistor, without providing discharge transistors respectively connected to the capacitors, for example.

In the voltage booster circuit, k may be N.

Since the number of stages in which the parasitic bipolar transistor elements are Darlington-connected can be maximized, the discharge operation is implemented with the maximum current amplification factor, whereby an electric charge can be discharged at high speed.

The voltage booster circuit may further comprise an output discharge transistor provided between the Nth well region and the first or second voltage, wherein, when the normal operation is performed, the output discharge transistor may be made nonconductive; and wherein, when the discharge operation is performed, the output discharge transistor may be made conductive.

If the Nth transistor is nonconductive during the discharge operation, the node from which the boost voltage is output can be discharged by using the output discharge transistor. Therefore, a problem in which an unexpected boost voltage is applied after the discharge operation can be prevented.

According to one embodiment of the present invention, there is provided a power supply circuit, comprising:

any of the above-described voltage booster circuits; and a voltage polarity reversal circuit which reverses the polarity of the boost voltage based on a voltage between the first voltage and the second voltage.

In this power supply circuit, the first voltage may be one of voltages applied to a segment electrode of a simple matrix liquid crystal panel;

the reverse bias voltage may be one of a high-potential-side voltage and a low-potential-side voltage applied to a common electrode of the simple matrix liquid crystal panel; and the boost voltage may be the other of the high-potential-side voltage and the low-potential-side voltage.

This makes it possible to provide a power supply circuit discharges an electric charge stored in capacitors due to the charge-pump operation at high speed with simple configuration.

According to one embodiment of the present invention, there is provided a liquid crystal driver, comprising:

the above-described power supply circuit; and a driver circuit which drives a segment electrode or a common electrode of a simple matrix liquid crystal panel by using at least one of the first voltage, the reverse bias voltage and the boost voltage.

This makes it possible to provide a liquid crystal driver which discharges an electric charge stored in capacitors due to the charge-pump operation at high speed with simple configuration and reliably prevents deterioration of a liquid crystal of a simple matrix liquid crystal panel.

These embodiments will be described in detail with reference to the drawings. Note that the embodiments described below do not in any way limit the scope of the invention laid out in the claims herein. In addition, not all of the elements of the embodiments described below should be taken as essential requirements of the present invention.

1. Liquid Crystal Device

FIG. 1 is a block diagram showing a liquid crystal device including a liquid crystal driver according to one embodiment of the present invention.

A liquid crystal device 510 includes a liquid crystal panel 520 and a liquid crystal driver 530.

The liquid crystal panel 520 includes a plurality of COM electrodes (common electrodes) (scan lines in a narrow sense), a plurality of SEG electrodes (segment electrodes) (data lines in a narrow sense), and pixels specified by the COM electrodes and the SEG electrodes. The liquid crystal panel 520 is a simple matrix liquid crystal panel.

In more detail, the liquid crystal panel 520 is formed on a panel substrate (glass substrate, for example). A plurality of COM electrodes $COM_1$ to $COM_M$ (M is a natural number greater than one), arranged in a direction Y shown in FIG. 1 and extending in a direction X, and a plurality of SEG electrodes $SEG_1$ to $SEG_N$ (N is a natural number greater than one), arranged in the direction X and extending in the direction Y, are disposed on the panel substrate. A pixel is formed at a position corresponding to the intersecting point of the COM electrode $COM_K$ ($1 \leqq K \leqq M$, K is a natural number) and the SEG electrode $SEG_L$ ($1 \leqq L \leqq N$, L is a natural number). Each pixel is formed by sealing a liquid crystal between the COM electrode and the SEG electrode, and the transmissivity of each pixel changes corresponding to the voltage applied between the COM electrode and the SEG electrode.

In the liquid crystal panel 520, the COM electrodes are alternately disposed toward the inside of the panel from two opposite sides of the panel in units of one COM electrode. The liquid crystal panel 520 is alternately driven from a first side of the liquid crystal panel 520 and a second side opposite to the first side in units of one COM electrode.

The liquid crystal driver 530 includes an X driver section 532, a Y driver section 534, and a power supply circuit 536. The X driver section 532 drives the SEG electrode $SEG_1$ to $SEG_N$ of the liquid crystal panel 520 based on display data. The Y driver section 534 sequentially selects the COM electrodes $COM_1$ to $COM_M$ of the liquid crystal panel 520. The power supply circuit 536 generates a drive voltage of the SEG electrode and a drive voltage of the COM electrode.

The liquid crystal driver 530 operates according to the content set by a host such as a central processing unit (CPU) (not shown) or a controller controlled by the host.

In more detail, the host or controller provides an operation mode setting and a vertical synchronization signal or a horizontal synchronization signal generated therein to the X driver section 532 and the Y driver section 534 of the liquid crystal driver 530, for example. The host or controller controls a boost factor setting and a discharge operation of the power supply circuit 536 of the liquid crystal driver 530, for example.

The power supply circuit 536 generates the drive voltages (V1, MV1, VC) of the SEG electrode and the drive voltages (V2, MV2, VC) of the COM electrode based on a system ground power supply voltage GND supplied from the outside and a system power supply voltage VDD supplied from the outside. The X driver section 532 applies one of the drive voltages V1, MV1, and VC generated by the power supply circuit 536 to the SEG electrode based on the display data. The Y driver section 534 applies one of the drive voltages V2, MV2, and VC generated by the power supply circuit 536 to the COM electrode.

Figure 2:
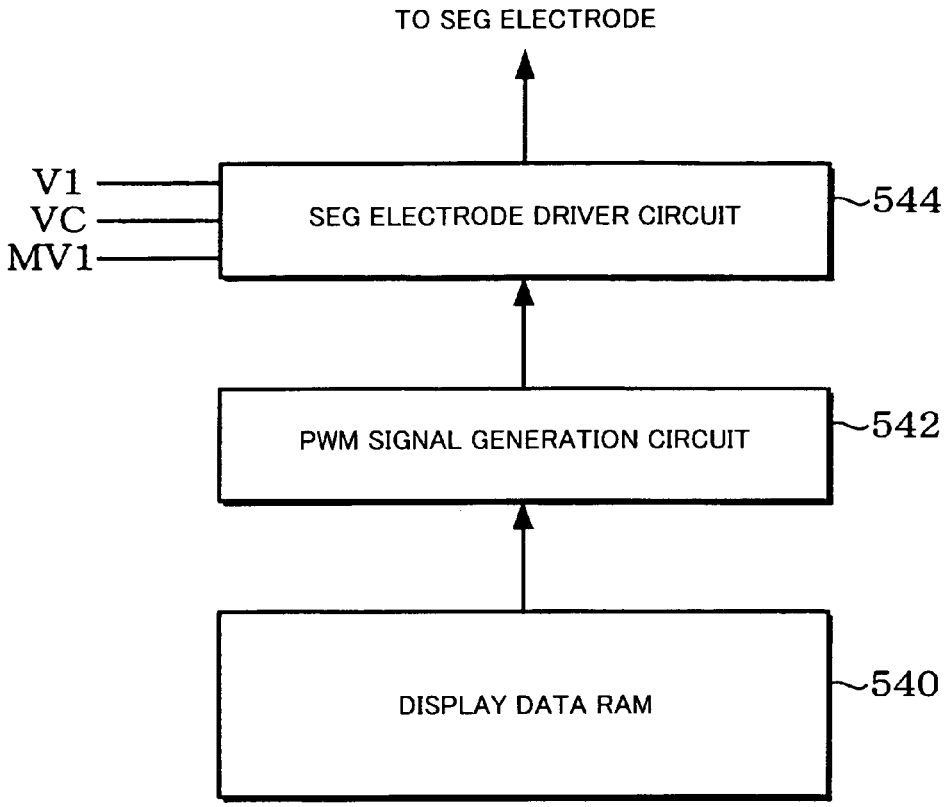
FIG. 2 is a block diagram showing an X driver section.

FIG. 2 is a block diagram showing the X driver section 532.

The X driver section 532 includes a display data RAM 540, a pulse width modulation (PWM) signal generation circuit 542, and a SEG electrode driver circuit 544 (driver circuit in a broad sense). The display data RAM 540 stores the display data for one vertical scan period, for example. The PWM signal generation circuit 542 reads the display data for one horizontal scan period from the display data RAM 540, and generates a PWM signal applied to each SEG electrode. The SEG electrode driver circuit 544 applies one of the drive voltages V1 and MV1 corresponding to the PWM signal generated by the PWM signal generation circuit 542 to the SEG electrode. The SEG electrode driver circuit 544 may apply the drive voltage VC to the SEG electrode in a non-display region. The drive voltage VC is a voltage in common with the Y driver section 534.

Figure 3:
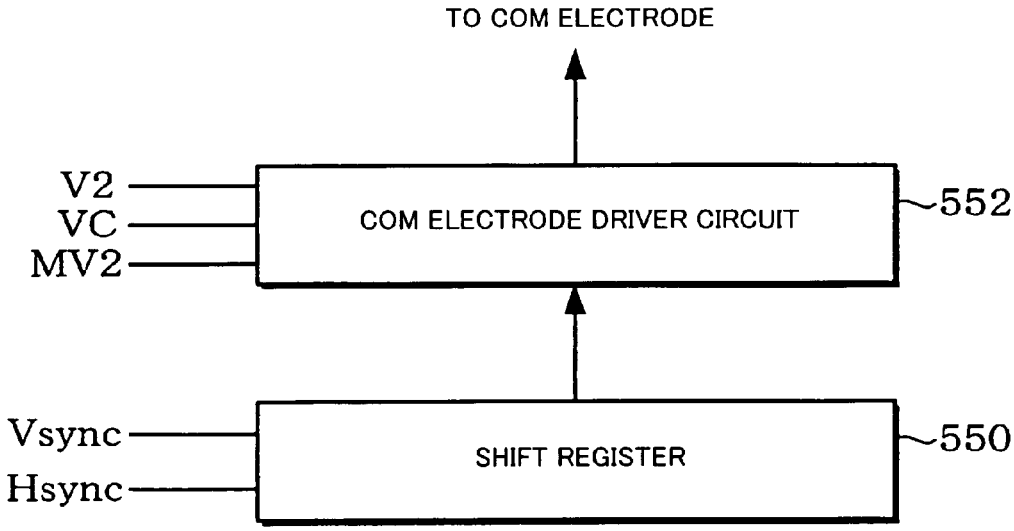
FIG. 3 is a block diagram showing a Y driver section.

FIG. 3 is a block diagram showing the Y driver section 534.

The Y driver section 534 includes a shift register 550 and a COM electrode driver circuit 552 (driver circuit in a broad sense). The shift register 550 includes a plurality of flip-flops which are provided corresponding to the COM electrodes and sequentially connected. The shift register 550 holds the vertical synchronization signal Vsync in the flip-flop in synchronization with the horizontal synchronization signal Hsync, and sequentially shifts the vertical synchronization signal Vsync to the adjacent flip-flop in synchronization with the horizontal synchronization signal Hsync.

The COM electrode driver circuit 552 converts the level of the voltage from the shift register 550 to the level of one of the drive voltages V2, MV2, and VC. The COM electrode driver circuit 552 outputs the level-converted voltage to the COM electrode. When the COM electrode corresponding to the flip-flop which holds the vertical synchronization signal Vsync shifted in the shift register 550 is selected, one of the drive voltages V2 and MV2 is applied to the COM electrode. The drive voltage VC is applied to unselected COM electrodes.

Figure 4:
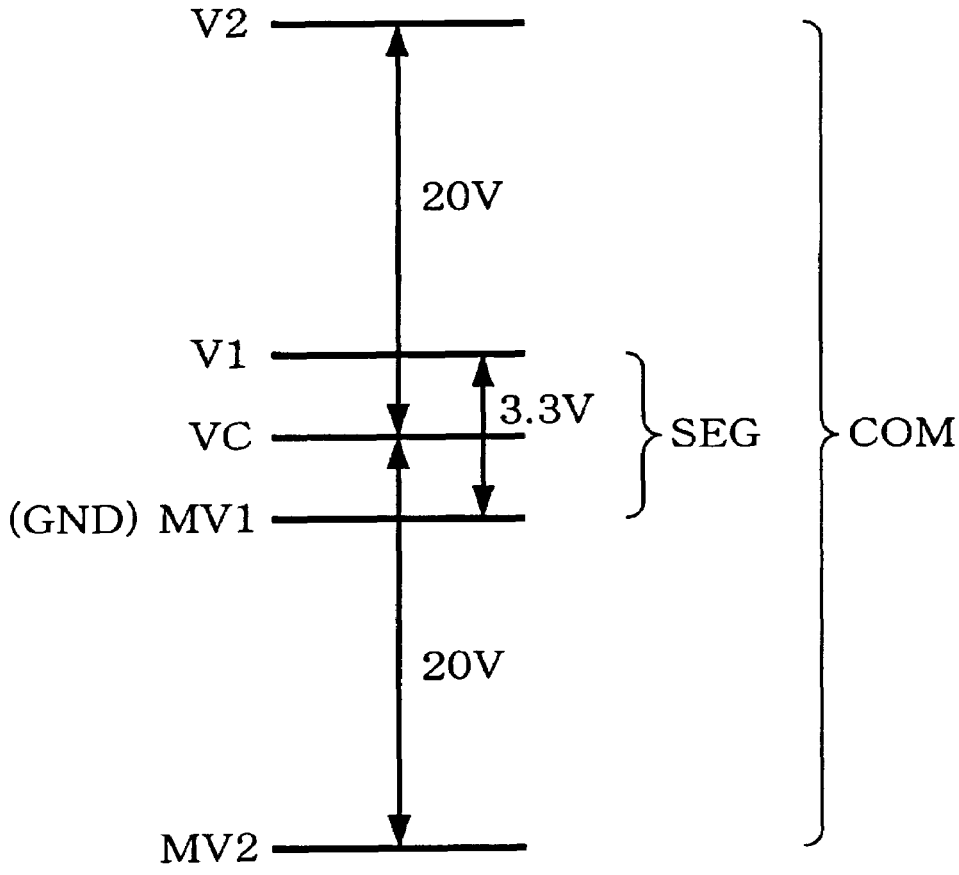
FIG. 4 is a diagram for illustrating the relationship among various liquid crystal drive voltages.

FIG. 4 is a diagram for illustrating the relationship among various liquid crystal drive voltages.

In this embodiment, the drive voltage VC is a voltage which can be commonly applied to the SEG electrode and the COM electrode. The SEG electrode drive voltages V1 and MV1 having the same amplitude in the positive direction or the negative direction are generated based on the drive voltage VC. Specifically, the middle voltage between the SEG electrode drive voltages V1 and MV1 is the drive voltage VC. The drive voltage MV1 may be the system ground power supply voltage GND. The voltage between the drive voltage V1 and the drive voltage MV1 is 3.3 V, for example.

The COM electrode drive voltages V2 and MV2 having the same amplitude in the positive direction or the negative direction are generated based on the drive voltage VC. The voltage between the drive voltage VC and the drive voltage V2 is 20 V, and the voltage between the drive voltage MV2 and the drive voltage VC is 20 V, for example.

Figure 5:
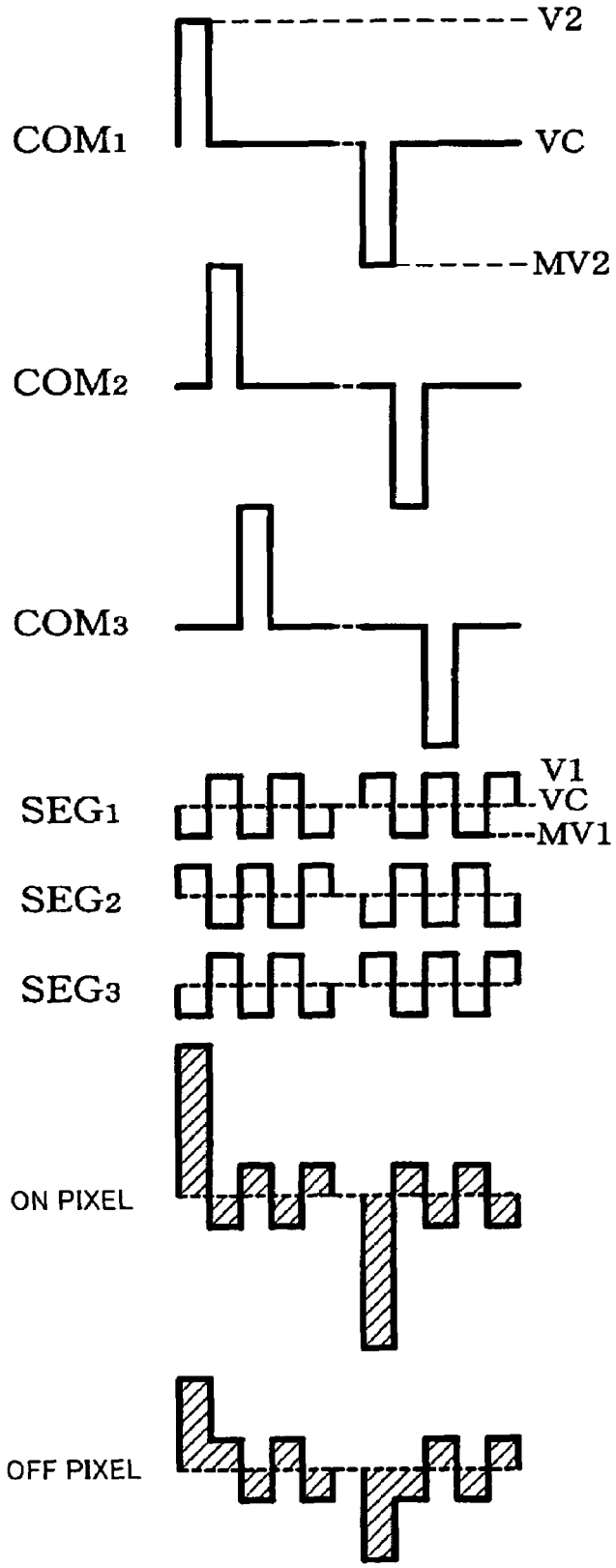
FIG. 5 shows waveforms of a COM electrode, a SEG electrode, an ON pixel, and an OFF pixel.

FIG. 5 shows waveforms of the COM electrode, the SEG electrode, an ON pixel, and an OFF pixel.

FIG. 5 schematically shows waveforms of the COM electrode $COM_1$ to $COM_3$ and waveforms of the SEG electrodes $SEG_1$ to $SEG_3$ when performing a polarity reversal drive in which the polarity is reversed in frame units.

The waveform of the pixel corresponding to the intersecting point of the COM electrode $COM_1$ and the SEG electrode $SEG_1$ is shown as the waveform of the ON pixel. The waveform of the pixel corresponding to the intersecting point of the COM electrode $COM_1$ and the SEG electrode $SEG_1$ is shown as the waveform of the OFF pixel. The simple matrix liquid crystal panel utilizes the properties of the liquid crystal which responds to the root-mean-square value determined by shaded areas of the ON pixel and the OFF pixel shown in FIG. 5.

2. Power Supply Circuit

Figure 6:
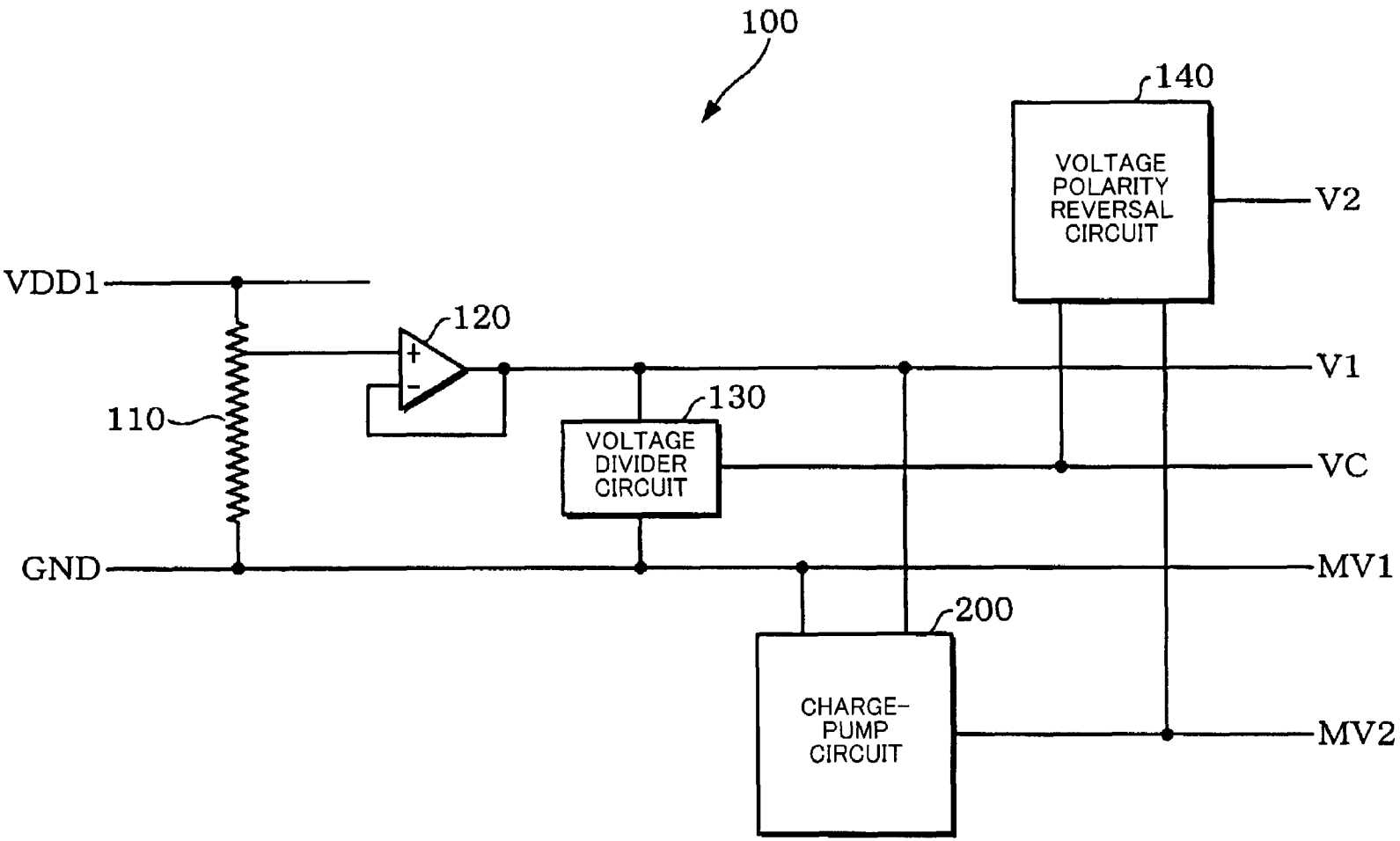
FIG. 6 is a block diagram showing a power supply circuit according to one embodiment of the present invention.

FIG. 6 is a block diagram showing a power supply circuit according to one embodiment of the present invention. A power supply circuit 100 in this embodiment may be applied as the power supply circuit 536 of the liquid crystal device shown in FIG. 1.

The power supply circuit 100 includes a resistance divider circuit 110, a regulator 120, a voltage divider circuit 130, a charge-pump circuit 200, and a voltage polarity reversal circuit 140.

The resistance divider circuit 110 is provided between a power supply voltage VDD1 and the system ground power supply voltage GND. The power supply voltage VDD1 may be generated by boosting the system power supply voltage VDD supplied from the outside in the power supply circuit 100, for example. A divided voltage obtained by dividing the voltage between the power supply voltage VDD1 and the system ground power supply voltage GND using the resistance divider circuit is supplied to the regulator 120. The voltage division point of the resistance divider circuit 110 can be changed based on a value set in a setting register (not shown), whereby a desired voltage between the power supply voltage VDD1 and the system ground power supply voltage GND can be supplied to the regulator 120.

The regulator 120 regulates the divided voltage supplied from the resistance divider circuit 110, and outputs the regulated voltage as the drive voltage V1. In more detail, the regulator 120 is formed by a voltage-follower-connected operational amplifier, converts the divided voltage through impedance conversion, and outputs the resulting voltage as the drive voltage V1.

The voltage divider circuit 130 is provided between the output of the regulator 120 and the system ground power supply voltage GND. The voltage divider circuit 130 outputs a divided voltage which is half of the voltage between the output voltage (drive voltage V1) of the regulator 120 and the system ground power supply voltage GND as the drive voltage VC.

The charge-pump circuit (voltage booster circuit in a broad sense) 200 generates the drive voltage MV2 based on the voltage between the output from the regulator 120 and the system ground power supply voltage GND. In more detail, the charge-pump circuit 200 generates the drive voltage MV2 by boosting the voltage between the drive voltage V1 which is the output from the regulator 120 and the system ground power supply voltage GND in the negative direction based on the system ground power supply voltage GND.

The voltage polarity reversal circuit 140 generates the drive voltage V2 obtained by reversing the polarity of the drive voltage MV2 generated by the charge-pump circuit 200 based on the drive voltage VC.

The drive voltages having the relationship shown in FIG. 4 are generated by the power supply circuit 100.

Therefore, the power supply circuit 100 may be construed to include the charge-pump circuit 200 (voltage booster circuit), and the voltage polarity reversal circuit 140 which reverses the polarity of the drive voltage MV2 based on the voltage VC between the power supply voltage VDD1 and the system ground power supply voltage GND (voltage between a first voltage and a second voltage).

Since the regulator 120 and the voltage divider circuit 130 of the power supply circuit 100 may be implemented by conventional configurations, description of the regulator 120 and the voltage divider circuit 130 is omitted.

Figure 7:
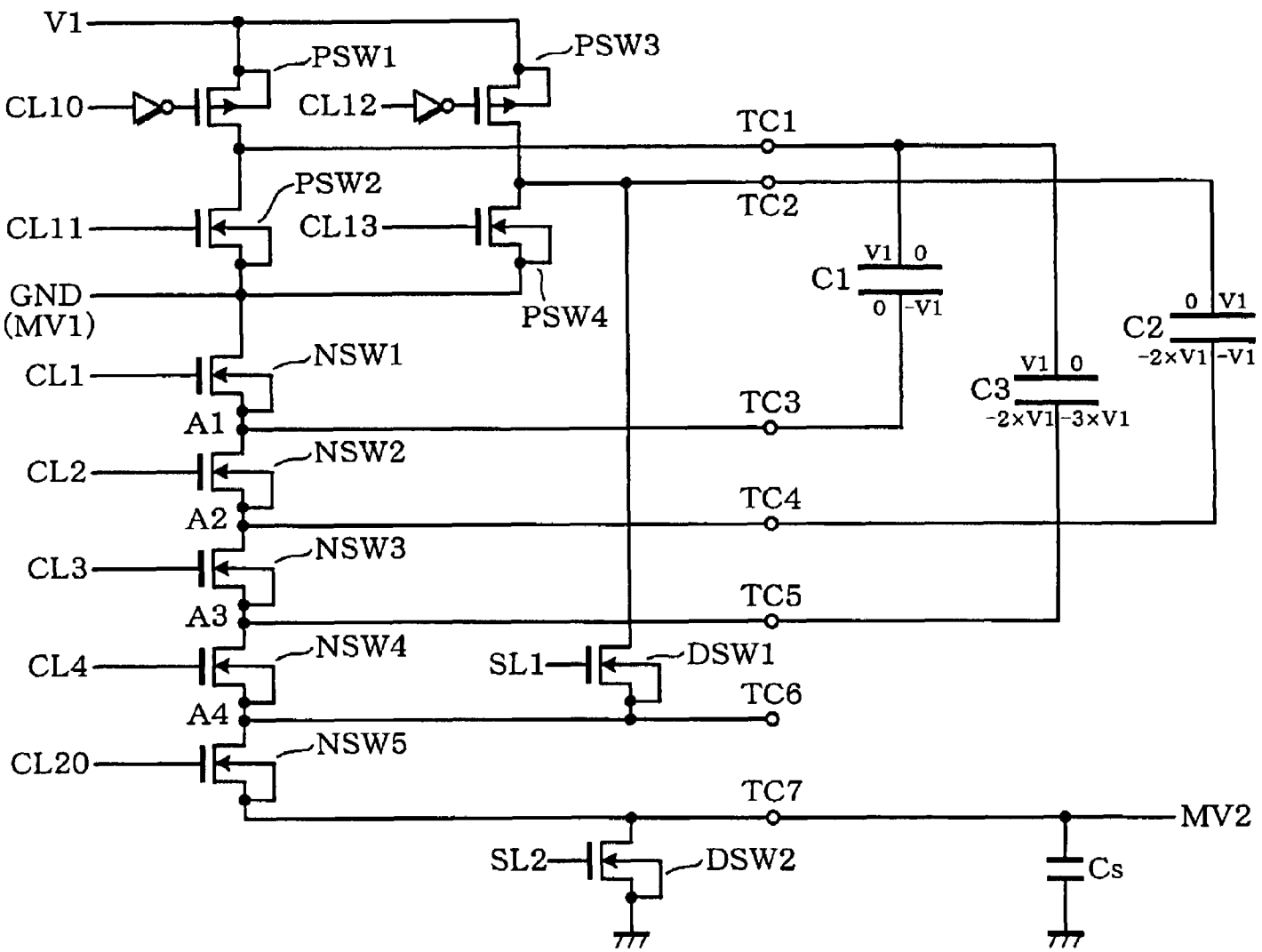
FIG. 7 shows a charge-pump circuit.

FIG. 7 shows the charge-pump circuit 200.

FIG. 7 shows a configuration of the charge-pump circuit which boosts the voltage between the drive voltage V1 and the system ground power supply voltage GND four times in the negative direction based on the ground power supply voltage GND. However, the present invention is not limited by the boost factor.

The charge-pump circuit 200 shown in FIG. 7 includes a switch element group for performing the charge-pump operation and external connection terminals TC1 to TC7, and capacitors for performing the charge-pump operation are connected outside the power supply circuit 100 (outside the liquid crystal driver when the power supply circuit 100 is applied to the liquid crystal driver). The following description is given on the assumption that a metal oxide semiconductor (MOS) transistor is used as the switch element. In the present specification, only the switch element group for performing the charge-pump operation is appropriately called a charge-pump circuit in a broad sense.

The charge-pump circuit 200 includes a p-type (first conductivity type, for example) MOS transistor PSW1 and an n-type (second conductivity type, for example) MOS transistor PSW2 connected in series between the drive voltage V1 and the system ground power supply voltage GND. The charge-pump circuit 200 includes a p-type MOS transistor PSW3 and an n-type MOS transistor PSW4 connected in series between the drive voltage V1 and the system ground power supply voltage GND. A connection node of the MOS transistors PSW1 and PSW2 is connected with one end of a capacitor connected with the external connection terminal TC1. A connection node of the MOS transistors PSW3 and PSW4 is connected with one end of a capacitor connected with the external connection terminal TC2.

The charge-pump circuit 200 further includes: first to Nth transistors (N is an integer greater than one) which are connected in series and used for the charge-pump operation, a first voltage being supplied to one end of the first transistor; and a discharge transistor having one end connected to a node which is connected to (k−1)th and kth transistors among the first to Nth transistors ($2 \leqq k \leqq N$, and k is an integer), the first voltage or a second voltage which is higher than the first voltage being supplied to the other end of the discharge transistor. FIG. 7 shows the case where k is N and N is five.

Specifically, the charge-pump circuit 200 shown in FIG. 7 includes n-type MOS transistors NSW1 to NSW5 (first to fifth transistors) which are connected in series and used for the charge-pump operation, the system ground power supply voltage GND (first voltage) being supplied to one end of the n-type MOS transistor NSW1 (first transistor).

In the case of forming the MOS transistors NSW1 to NSW5 in a p-type semiconductor substrate, the MOS transistors NSW1 to NSW5 may be implemented by using a triple-well structure.

The charge-pump circuit 200 includes a discharge transistor DSW1 having one end connected to a node which is connected to the MOS transistors NSW4 and NSW5, the system ground power supply voltage GND or the drive voltage V1 (which is a first voltage or a voltage higher than the first voltage) being supplied to the other end of the discharge transistor DSW1. The discharge transistor DSW1 may be implemented by n-type MOS transistors.

The external connection terminal TC3 is connected with a connection node of the MOS transistors NSW1 and NSW2. The external connection terminal TC4 is connected with a connection node of the MOS transistors NSW2 and NSW3. The external connection terminal TC5 is connected with a connection node of the MOS transistors NSW3 and NSW4. The external connection terminal TC6 is connected with a connection node of the MOS transistors NSW4 and NSW5. The external connection terminal TC7 is connected with a drain of the MOS transistor NSW5.

The charge-pump circuit 200 may include an output discharge transistor DSW2 connected with the drain of the MOS transistor NSW5. The output discharge transistor DSW2 may be implemented by an n-type MOS transistor.

A capacitor C1 is externally connected between the external connection terminals TC1 and TC3. A capacitor C2 is externally connected between the external connection terminals TC2 and TC4. A capacitor C3 is externally connected between the external connection terminals TC1 and TC5. A capacitor C4 is externally connected between the external connection terminals TC2 and TC6. A stabilization capacitor Cs is externally connected between the external connection terminal TC7 and the system ground power supply voltage GND.

In the charge-pump circuit 200 having such configuration, the discharge transistor DSW1 and the output discharge transistor DSW2 are made nonconductive during the normal operation, and the drive voltage MV2 is output as the boost voltage by the charge-pump operation using the MOS transistors PSW1 to PSW4 and NSW1 to NSW5 and is held by the stabilization capacitor Cs. In this case, the drive voltage MV2 is a voltage obtained by boosting the voltage between the system ground power supply voltage GND and the drive voltage V1 four times in the negative direction based on the system ground power supply voltage GND.

In order to perform the charge-pump operation during the normal operation of the charge-pump circuit 200, charge clock signals CL10 to CL13 and CL1 to CL5 are respectively supplied to gate electrodes of the MOS transistors PSW1 to PSW4 and NSW1 to NSW5.

Figure 8:
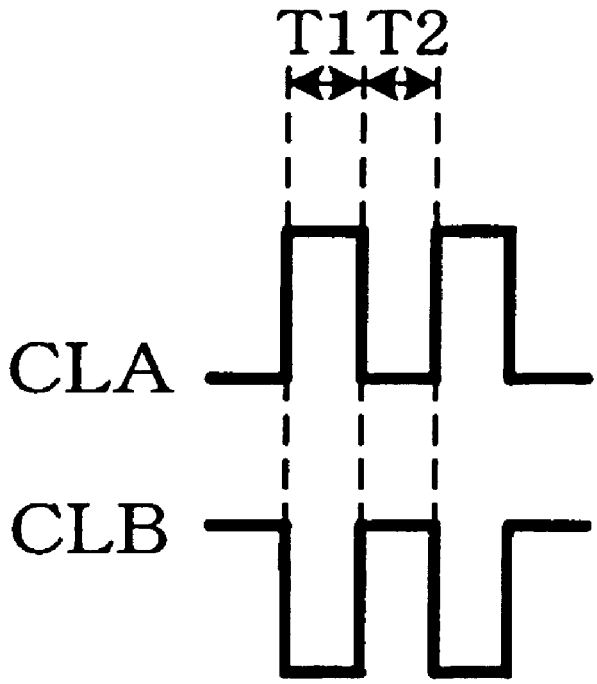
FIG. 8 shows two clock signals which provide reference timings of charge clock signals.
Figure 9:
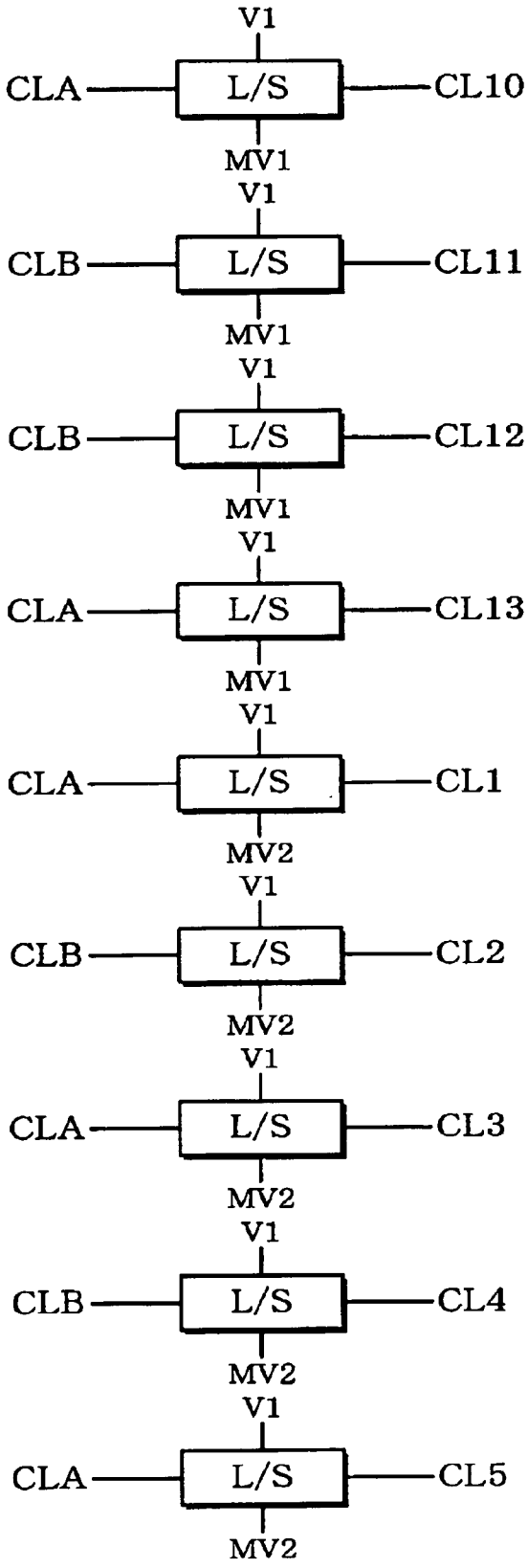
FIG. 9 shows a generation circuit for charge clock signals.

FIGS. 8 and 9 illustrate the charge clock signals.

FIG. 8 shows two clock signals CLA and CLB which provide reference timings of the charge clock signals CL10 to CL13 and CL1 to CL5. The phases of the clock signals CLA and CLB are the reverse of each other. For example, the clock signal CLA is set at the H level and the clock signal CLB is set at the L level in a first period T1, and the clock signal CLA is set at the L level and the clock signal CLB is set at the H level in a second period T2.

FIG. 9 shows a generation circuit for the charge clock signals CL10 to CL13 and CL1 to CL5. The charge clock signals CL10 to CL13 and CL1 to CL5 are clock signals generated by converting one of the clock signals CLA and CLB to the voltage level of each MOS transistor. For example, the charge clock signal CL1 is generated as a clock signal obtained by converting the amplitude of the clock signal CLA to the amplitude of the voltage between the system ground power supply voltage GND (MV 1) and the drive voltage V1. The charge clock signal CL4 is generated as a clock signal obtained by converting the amplitude of the clock signal CLB to the amplitude of the voltage between the drive voltage MV2 and the drive voltage V1.

In FIG. 7, the MOS transistor PSW1 is turned ON and the MOS transistor PSW2 is turned OFF in the first period T1, whereby one end of the capacitor C1 is connected with the drive voltage V1. In this case, since the MOS transistor NSW1 is turned ON and the MOS transistor NSW2 is turned OFF, the other end of the capacitor C1 is connected with the system ground power supply voltage GND.

In the second period T2, the MOS transistor PSW1 is turned OFF and the MOS transistor PSW2 is turned ON, whereby one end of the capacitor C1 is connected with the system ground power supply voltage GND. In this case, since the MOS transistor NSW1 is turned OFF and the MOS transistor NSW2 is turned ON, the potential (−V1) of the other end of the capacitor C1 is set at the potential of one end of the capacitor C2. In the second period T2, since the MOS transistor PSW3 is turned ON and the MOS transistor PSW4 is turned OFF, the other end of the capacitor C2 is connected with the drive voltage V1. The capacitor C2 has stored an electric charge corresponding to a voltage of 2×V1.

Specifically, the charge-pump circuit 200 may include the MOS transistor NSW1 (or the first transistor) having one end to which the system ground power supply voltage GND (first voltage) is supplied, and applying the system ground power supply voltage GND to one end of the capacitor C1 (the first capacitor) in the first period T1. The other end of the capacitor C1 has the drive voltage V1 (or the second voltage) in the first period T1 and the system ground power supply voltage GND in the second period T2. The charge-pump circuit 200 may be construed to further include the MOS transistors NSW2 to NSWN (second to Nth transistors) as described below.

The MOS transistor NSW1 (or the ith transistor) ($2 \leqq i \leqq N$, N is an integer greater than two and i is an even number) has one end connected to one end of the MOS transistor NSW(i−1) (or the (i−1)th transistor), and connects one end of the capacitor Ci (or the ith capacitor) to one end of the capacitor C(i−1) ((i−1)th capacitor) in the second period T2. The other end of the capacitor C1 has the system ground power supply voltage GND in the first period T1 and the drive voltage V1 in the second period T2.

The MOS transistor NSWj (or the jth transistor) ($3 \leqq j \leqq N$, j is an odd number) has one end connected to one end of the MOS transistor NSW(j−1) (or the (j−1)th transistor), and connects one end of the capacitor Cj (or the jth capacitor) to one end of the capacitor C(j−1) (j−1)th capacitor) in the first period T1. The other end of the capacitor Cj has the drive voltage V1 in the first period T1 and the system ground power supply voltage GND in the second period T2.

FIG. 7 shows an example of the voltage applied to one end of each capacitor in the first and second periods T1 and T2.

An electric charge corresponding to a voltage of "4×V1" is stored in the capacitor C4 by repeating the above-described charge-pump operation using the capacitors in synchronization with the charge clock signals generated as shown in FIGS. 8 and 9.

Figure 10:
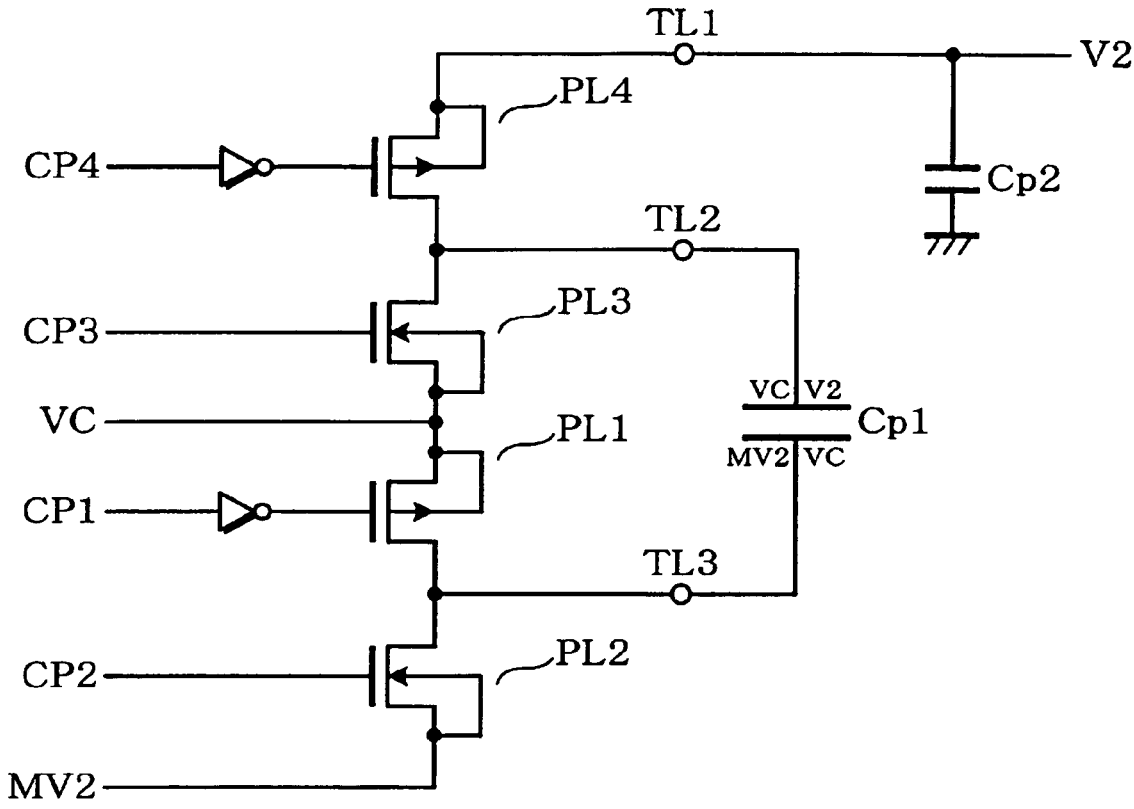
FIG. 10 shows the voltage polarity reversal circuit of FIG. 6.

FIG. 10 shows the voltage polarity reversal circuit 140.

The voltage polarity reversal circuit 140 includes a p-type MOS transistor PL1 and an n-type MOS transistor PL2 connected in series between the drive voltages VC and MV2. The voltage polarity reversal circuit 140 includes an n-type MOS transistor PL3 and a p-type MOS transistor PL4. The p-type MOS transistor PL4 is connected with a drain of the n-type MOS transistor PL3 to which the drive voltage VC is supplied at a source.

The voltage polarity reversal circuit 140 includes external connection terminals TL1 to TL3. The external connection terminal TL1 is connected with a source of the MOS transistor PL4. The external connection terminal TL2 is connected with a connection node of the MOS transistors PL3 and PL4. The external connection terminal TL3 is connected with a connection node of the MOS transistors PL1 and PL2.

A capacitor Cp1 is externally connected between the external connection terminals TL2 and TL3. A capacitor Cp2 is externally connected between the external connection terminal TL1 and the system ground power supply voltage GND.

Charge clock signals applied to gate electrodes of the MOS transistors PL1 to PL4 may be synchronous or asynchronous with the charge clock signals of the charge-pump circuit 200 shown in FIG. 7. The charge clock signals are supplied to the gate electrodes of the MOS transistors PL1 to PL4 so that the drive voltages VC and MV2 are applied to either end of the capacitor Cp1 in the first period T1, and the drive voltage VC is applied to the end of the capacitor to which the drive voltage MV2 has been applied in the second period T2.

The power supply circuit 100 in this embodiment can generate a plurality of drive voltages having the relationship shown in FIG. 4 as described above.

3. Charge-Pump Circuit

In the charge-pump circuit 200 having the configuration shown in FIG. 7, the discharge transistor DSW1 and the output discharge transistor DSW2 are made nonconductive during the normal operation, and the drive voltage MV2 is output as a four-fold boost voltage by the charge-pump operation using the MOS transistors PSW1 to PSW4 and NSW1 to NSW5.

The charge-pump circuit 200 having such configuration may implement a three-fold boost, a two-fold boost, and the like by omitting the connection of the capacitor.

Figure 11:
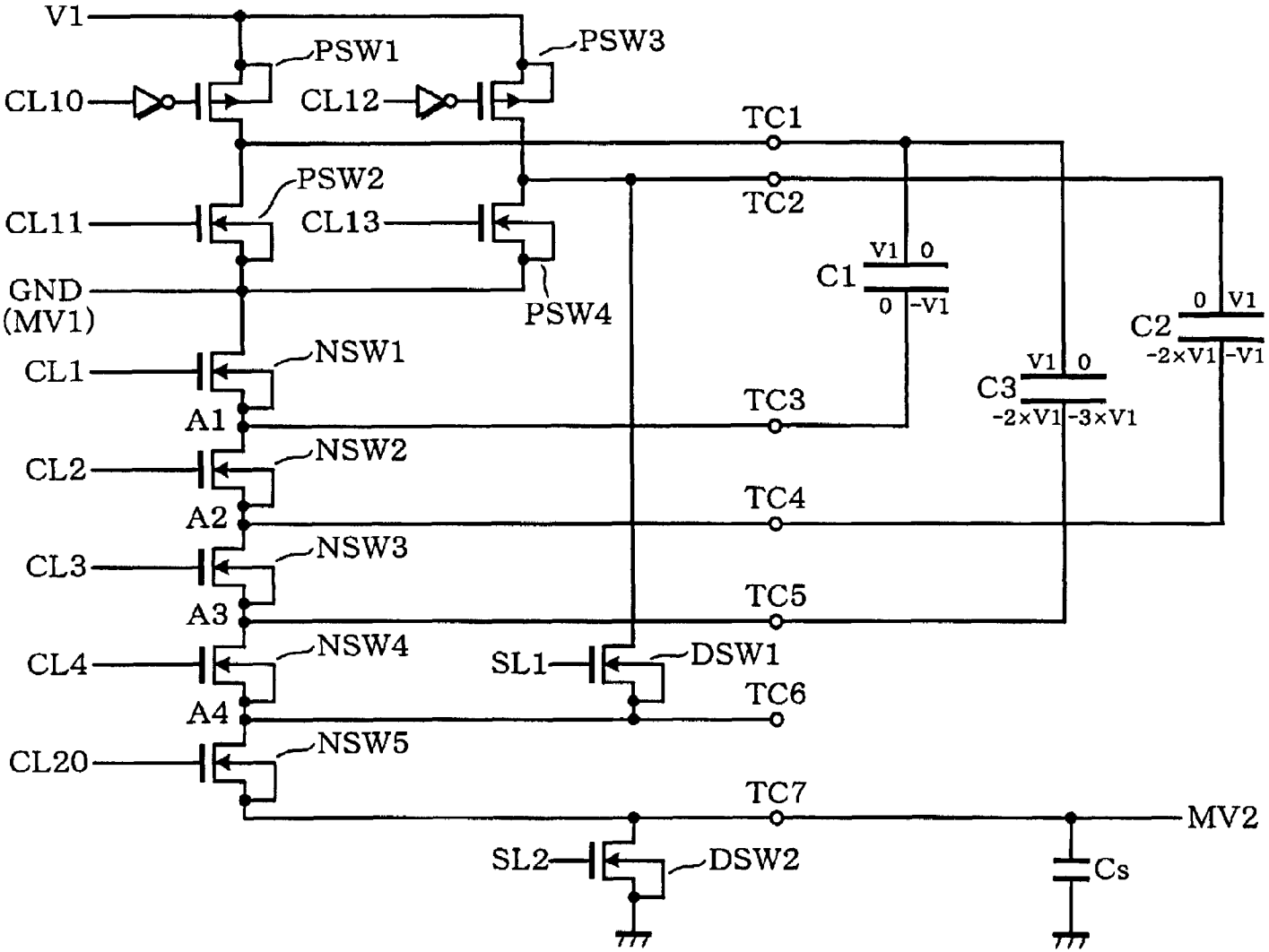
FIG. 11 shows capacitor connections of a charge-pump circuit during a three-fold boost according to one embodiment of the present invention.

FIG. 11 shows capacitor connections of a charge-pump circuit during a three-fold boost according to one embodiment of the present invention.

In FIG. 11, sections the same as the sections of the charge-pump circuit 200 shown in FIG. 7 are indicated by the same symbols. Description of these sections is appropriately omitted. The charge-pump circuit shown in FIG. 11 which performs the three-fold boost differs from the charge-pump circuit shown in FIG. 7 which performs the four-fold boost in that the connection of the capacitor C4 is omitted in FIG. 11. These charge-pump circuits also differ in that a charge clock signal CL20 is supplied to the gate electrode of the MOS transistor NSW5 so that the MOS transistor NSW5 is always conductive during the normal operation.

Figure 12:
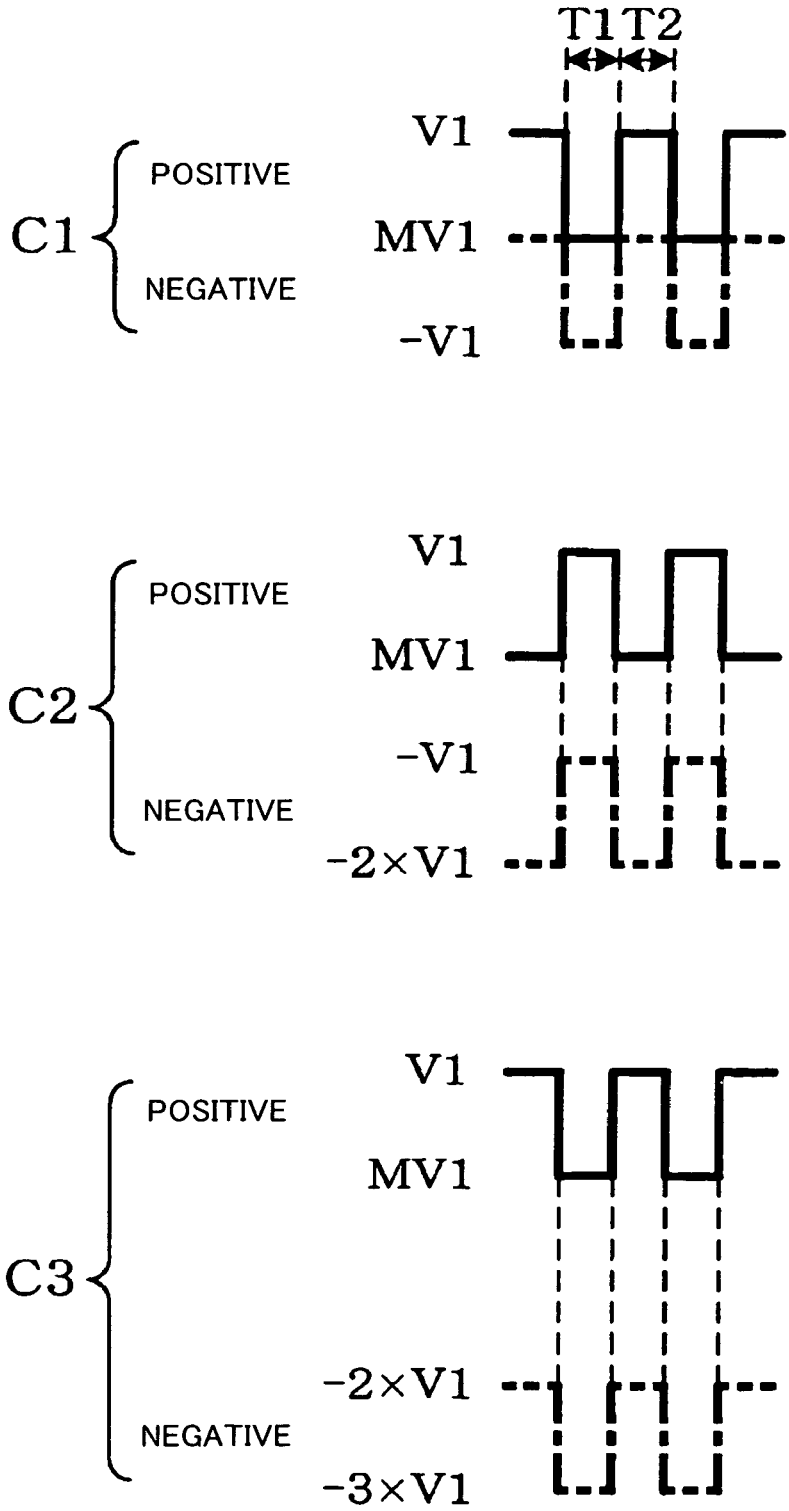
FIG. 12 shows voltage waveforms on the ends of capacitors connected to the charge-pump circuit shown of FIG. 11.

FIG. 12 shows voltage waveforms on the ends of the capacitors connected to the charge-pump circuit shown in FIG. 11.

In FIG. 12, one end of the capacitor connected with one of the MOS transistors PSW1 to PSW4 is the positive side, and the other end of the capacitor connected with one of the MOS transistors NSW1 to NSW5 is the negative side.

Since the operation is the same during the three-fold boost and the four-fold boost excluding the MOS transistor NSW5, description of the operation is omitted.

The charge-pump circuit 200 having such a configuration has a triple-well structure, and the voltage applied to a predetermined region of the triple-well structure can be changed toward the system ground power supply voltage GND at high speed by using only the discharge transistor DSW1 without providing an additional discharge transistor.

This feature is described below.

Figure 13:
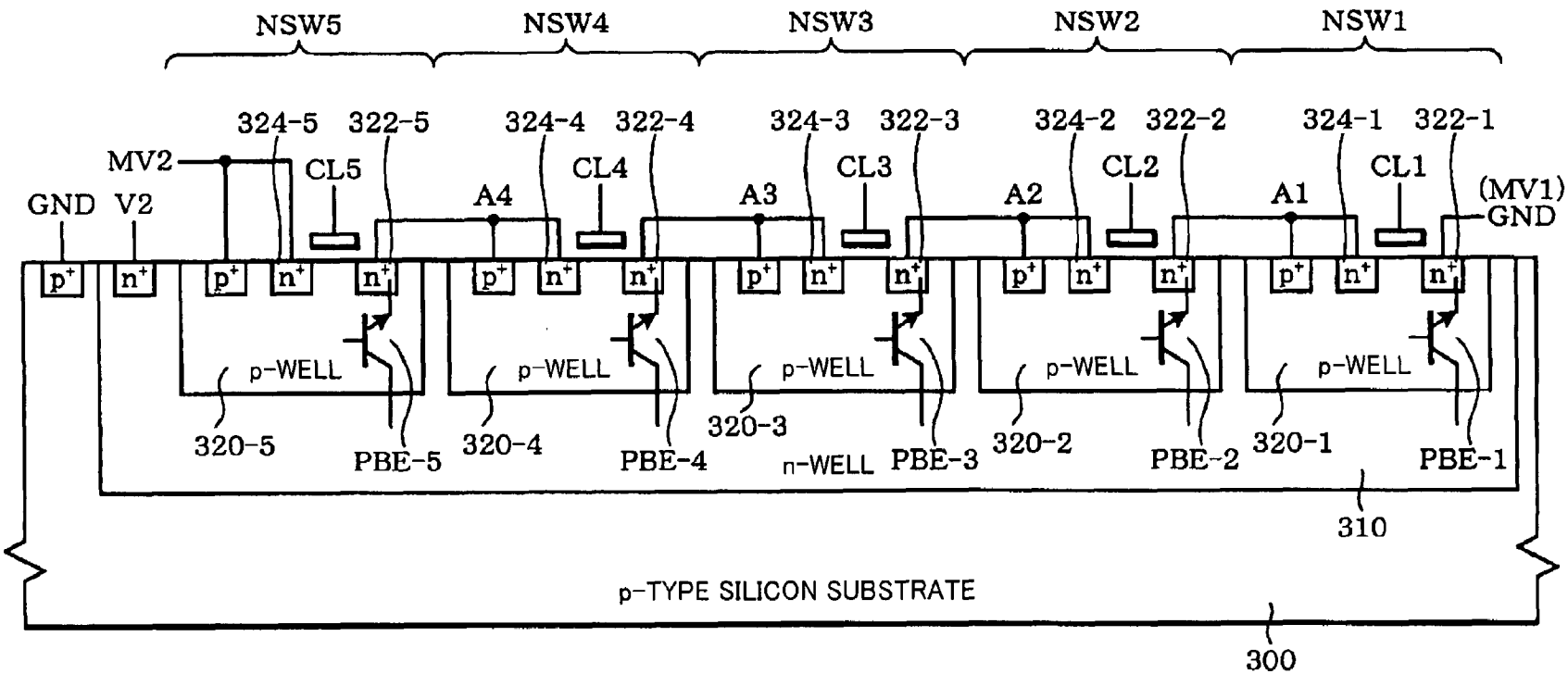
FIG. 13 is a cross-sectional view showing MOS transistors formed in a p-type semiconductor substrate.

FIG. 13 is a cross-sectional view showing the MOS transistors NSW1 to NSW5 formed in a p-type semiconductor substrate. The same components shown in FIGS. 13 and 11 are denoted by the same reference numbers.

In the case of forming the charge-pump circuit 200 shown in FIGS. 7 and 11 on a p-type semiconductor substrate, it is necessary to use the triple-well structure. In the case where the MOS transistors NSW1 to NSW5 are formed in a p-type (first conductivity type, for example) silicon substrate 300 (substrate in a broad sense), an n-well 310 (n-type (second conductivity type, for example) well region) is formed in the p-type silicon substrate 300. First to fifth p-wells (p-type first to fifth well regions) 320-1 to 320-5 are formed in the n-well 310. The MOS transistors NSW1 to NSW5 are respectively formed in the first to fifth p-wells 320-1 to 320-5.

The system ground power supply voltage GND is supplied to the p-type silicon substrate 300 through a $p^+$ region. A reverse bias voltage is supplied to the n-well 310 through an $n^+$ region for a reverse bias to the first to fifth p-wells. It is preferable that the reverse bias voltage be the highest voltage used in the power supply circuit 100 in order to prevent latchup. In FIG. 13, the drive voltage V2 shown in FIG. 4 is used as the reverse bias voltage. Therefore, the reverse bias voltage may be referred to as the high-potential-side voltage of the high-potential-side voltage and the low-potential-side voltage applied to the scan electrode of the liquid crystal panel 520. Since the drive voltage V2 is generated based on the drive voltage MV2, the reverse bias voltage may be referred to as a voltage generated based on the boost voltage.

In FIG. 13, the first to fifth p-wells 320-1 to 320-5 are formed in the n-well 310. However, the present invention is not limited thereto. The first to fifth p-wells 320-1 to 320-5 may be respectively formed in n-wells separated from one another. However, the reverse bias voltage is respectively applied to the separated n-wells.

In the well regions formed by the first to fifth p-wells 320-1 to 320-5, n-type drain regions 322-1 to 322-5 and source regions 324-1 to 324-5 are respectively formed.

A gate electrode of the MOS transistor NSW1 (first transistor) is provided on a channel region between the drain region 322-1 and the source region 324-1 through an insulating film. A gate electrode of the MOS transistor NSW2 (second transistor) is provided on a channel region between the drain region 322-2 and the source region 324-2 through an insulating film. A gate electrode of the MOS transistor NSW3 (third transistor) is provided on a channel region between the drain region 322-3 and the source region 324-3 through an insulating film. A gate electrode of the MOS transistor NSW4 (fourth transistor) is provided on a channel region between the drain region 322-4 and the source region 324-4 through an insulating film. A gate electrode of the MOS transistor NSW5 (fifth transistor) is provided on a channel region between the drain region 322-5 and the source region 324-5 through an insulating film.

The system ground power supply voltage GND is supplied to the drain region 322-1 of the first p-well 320-1. The source region 324-(m−1) of the (m−1)th ($2 \leqq m \leqq 5$, m is an integer) p-well 320-(m−1) is electrically connected with the drain region 322-m of the mth p-well 320-m, and the voltage of the source region 324-5 of the fifth p-well 320-5 becomes the drive voltage MV2.

In FIG. 13, an npn-type first parasitic bipolar transistor element PBE-1 having the first p-well 320-1 as a base region, the n-well 310 as a collector region, and the drain region 322-1 as an emitter region is formed. An npn-type second parasitic bipolar transistor element PBE-2 having the second p-well 320-2 as a base region, the n-well 310 as a collector region, and the drain region 322-2 as an emitter region is formed. An npn-type third parasitic bipolar transistor element PBE-3 having the third p-well 320-3 as a base region, the n-well 310 as a collector region, and the drain region 322-3 as an emitter region is formed. An npn-type fourth parasitic bipolar transistor element PBE-4 having the fourth p-well 320-4 as a base region, the n-well 310 as a collector region, and the drain region 322-4 as an emitter region is formed. An npn-type fifth parasitic bipolar transistor element PBE-5 having the fifth p-well 320-5 as a base region, the n-well 310 as a collector region, and the drain region 322-5 as an emitter region is formed.

Figures 14, 15:
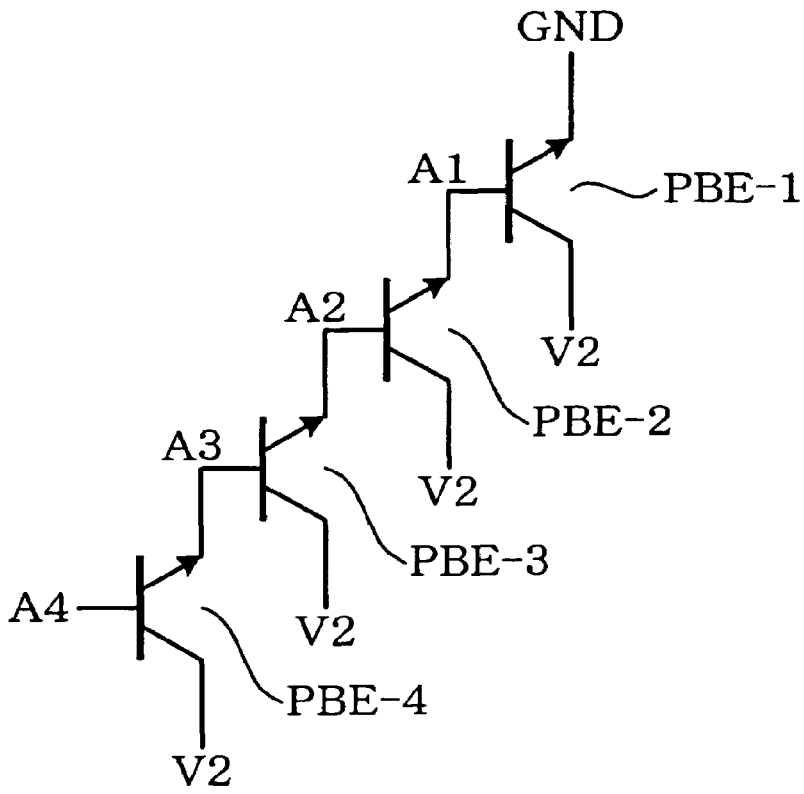
FIG. 14 is a table for describing control of a MOS transistor, a discharge transistor and an output discharge transistor.
FIG. 15 shows Darlington-connected parasitic bipolar transistor elements shown in FIG. 13.

FIG. 14 is a table for describing control of the MOS transistor NSW5, the discharge transistor DSW1, and the output discharge transistor DSW2.

In the charge-pump circuit 200 which performs the threefold boost, the MOS transistor NSW5 is made conductive and the discharge transistor DSW1 and the output discharge transistor DSW2 are made nonconductive during the normal operation.

During the discharge operation for discharging an electric charge stored in the capacitor of the charge-pump circuit 200 when removing electric power, the MOS transistor NSW5 is made nonconductive and the discharge transistor DSW1 and the output discharge transistor DSW2 are made conductive.

Since the MOS transistor NSW5 is made nonconductive and the discharge transistor DSW1 is made conductive during the discharge operation, the voltage of a connection node A4 of the MOS transistors NSW4 and NSW5 is set at the system ground power supply voltage GND or the drive voltage V1.

This causes the base region of the parasitic bipolar transistor element PBE-4 to be set at the system ground power supply voltage GND or the drive voltage V1. As a result, the fourth parasitic bipolar transistor element PBE-4 is turned ON, whereby the first to fourth parasitic bipolar transistor elements PBE-1 to PBE-4 are Darlington-connected as shown in FIG. 15. Specifically, a current path is formed from the reverse bias voltage V2 toward the system ground power supply voltage GND by causing the parasitic bipolar transistor elements PBE-1 to PBE-4 to be turned ON.

The current amplification factor is small even if the parasitic bipolar transistor element PBE-4 is turned ON. However, if the number of stages of Darlington connection of the parasitic bipolar transistor elements is increased due to a reduction of manufacturing process or an increase in the number of stages of the MOS transistors connected in series, the current amplification factor is increased to that extent, whereby the voltage applied to the n-well 310 changes to the system ground power supply voltage GND at high speed. In particular, when the reverse bias voltage V2 applied to the n-well 310 is generated by the charge-pump operation as in the voltage polarity reversal circuit 140 shown in FIG. 10, the electric charge in the capacitor Cp2 can be discharged at high speed merely by providing the discharge transistor DSW1. Since the voltages of connection nodes A1 to A3 also approach the system ground power supply voltage GND, the speed of the discharge operation can be increased only by the discharge transistor DSW1 without providing an additional discharge transistor.

In FIG. 11, one end of the discharge transistor DSW1 is connected with the connection node A4. However, the present invention is not limited thereto. The discharge transistor DSW1 may be connected with the connection node A3, A2, or A1. However, since the number of stages of Darlington connection is increased as shown in FIG. 15 by connecting the discharge transistor DSW1 with the connection node A4, the current amplification factor is increased, whereby the discharge operation at higher speed can be implemented.

As described above, the charge-pump circuit 200 in this embodiment enables the discharge operation for discharging the electric charge stored in the capacitor when removing electric power to be achieved at high speed using a simple configuration.

Figure 16A:
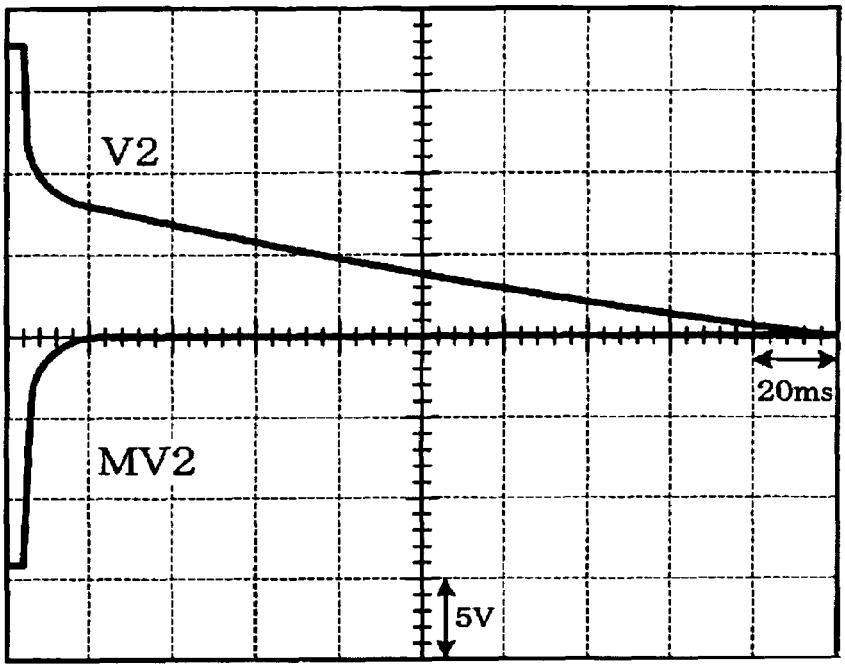
FIGS. 16A and 16B are graphs showing waveforms of the discharge operation in a comparative example of the present invention.
Figure 16B:
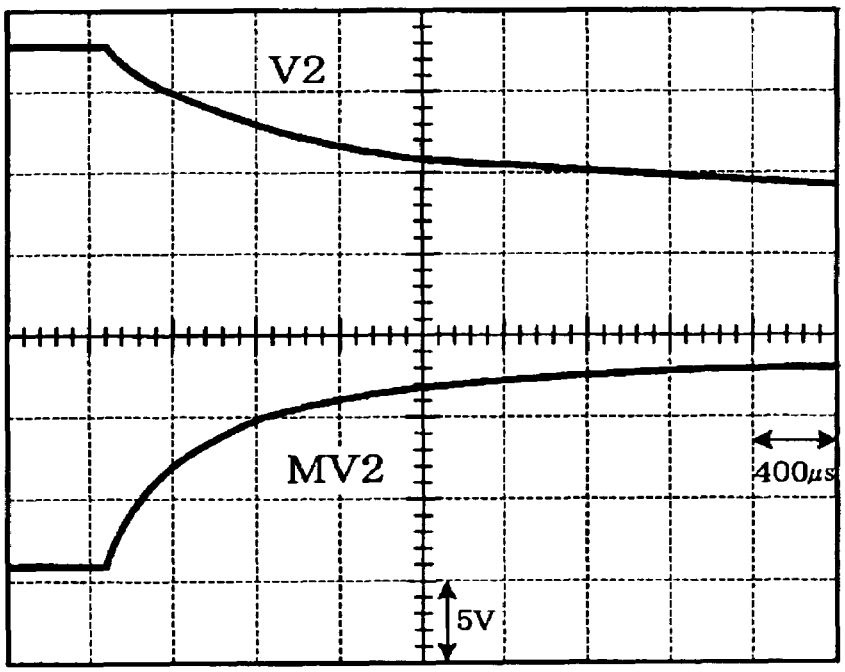

FIGS. 16A and 16B show waveforms of the discharge operation in a comparative example. In the comparative example, a discharge transistor is provided on each end of all the capacitors which contribute to the charge-pump operation. The discharge transistors are simultaneously made conductive in the discharge operation.

Figure 17A:
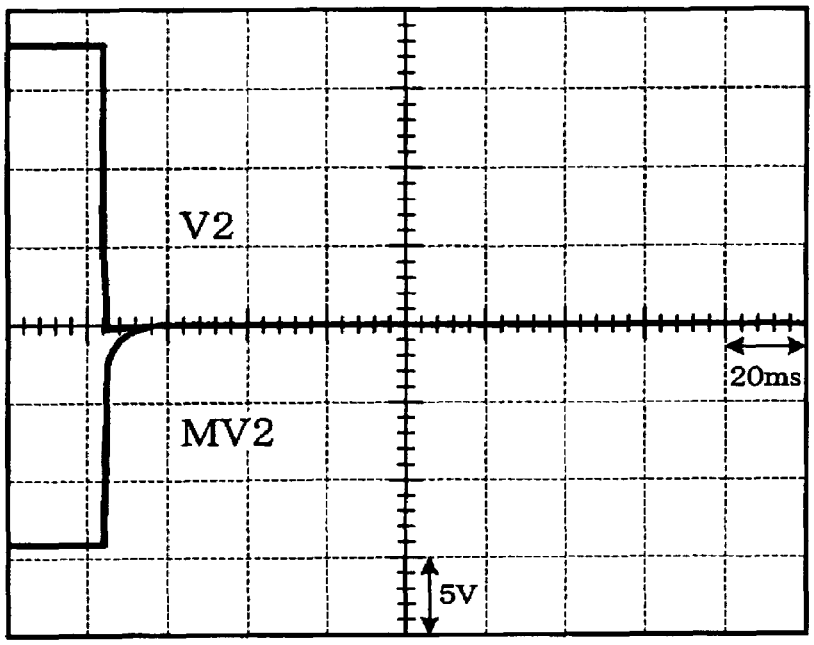
FIGS. 17A and 17B are graphs showing waveforms of the discharge operation according to one embodiment of the present invention.
Figure 17B:
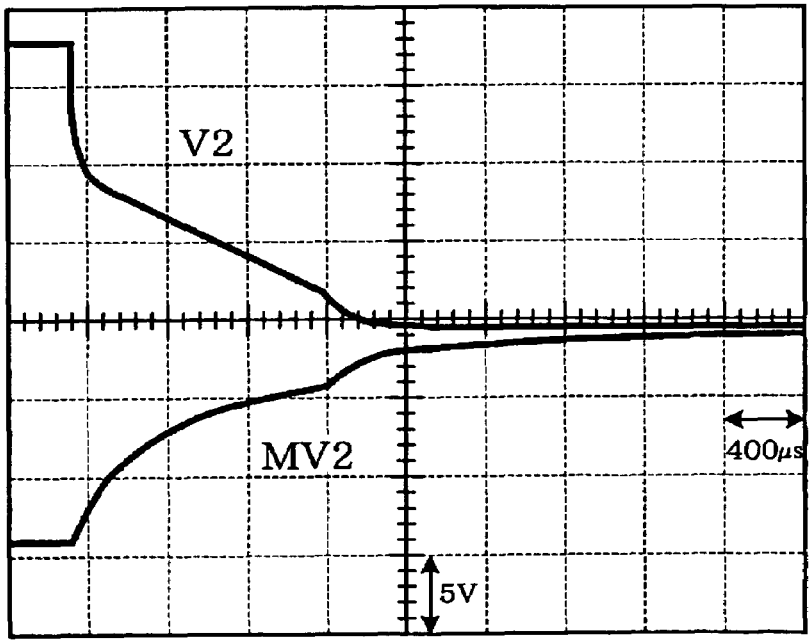

FIGS. 17A and 17B show waveforms of the discharge operation according to one embodiment of the present invention.

In FIGS. 16A and 17A, the horizontal axis is 20 ms/div and the vertical axis is 5 V/div. In FIGS. 16B and 17B, the horizontal axis is 400 μs/div and the vertical axis is 5 V/div.

When FIG. 16B is compared with FIG. 17B, the drive voltage V2 applied as the reverse bias voltage falls to the system ground power supply voltage GND at high speed.

The drive voltage MV2 which is the boost voltage generated by the charge-pump circuit 200 also falls to the system ground power supply voltage GND at an equal or higher speed even though only one discharge transistor DSW1 is provided.

When the above-described charge-pump circuit 200 is applied to the power supply circuit 100, the system ground power supply voltage GND (=MV1) (first voltage) may be used as one of the voltages applied to a segment electrode of a simple matrix liquid crystal panel. The high-potential-side voltage of the high-potential-side voltage and the low-potential-side voltage applied to a common electrode of the liquid crystal panel may be used as the reverse bias voltage, and the low-potential-side voltage of the high-potential-side voltage and the low-potential-side voltage applied to the common electrode may be used as the drive voltage MV2 which is the boost voltage.

A liquid crystal driver which includes such a power supply circuit and a driver circuit which drives a segment electrode or a common electrode of a simple matrix liquid crystal panel using at least one of the system ground power supply voltage GND (first voltage), the drive voltage V2 (reverse bias voltage), and the drive voltage MV2 (boost voltage) can be provided.

4. Modification

The charge-pump circuit formed on a p-type silicon substrate is described in the above embodiment. However, the present invention is not limited thereto. A charge-pump circuit may be formed on an n-type silicon substrate. A charge-pump circuit 350 formed on an n-type silicon substrate may also be applied to the power supply circuit shown in FIG. 6 and the liquid crystal driver shown in FIG. 1. In this case, the charge-pump circuit 350 generates the drive voltage V2, and the voltage polarity reversal circuit generates the drive voltage MV2 obtained by reversing the polarity of the drive voltage V2 based on the drive voltage VC.

Figure 18:
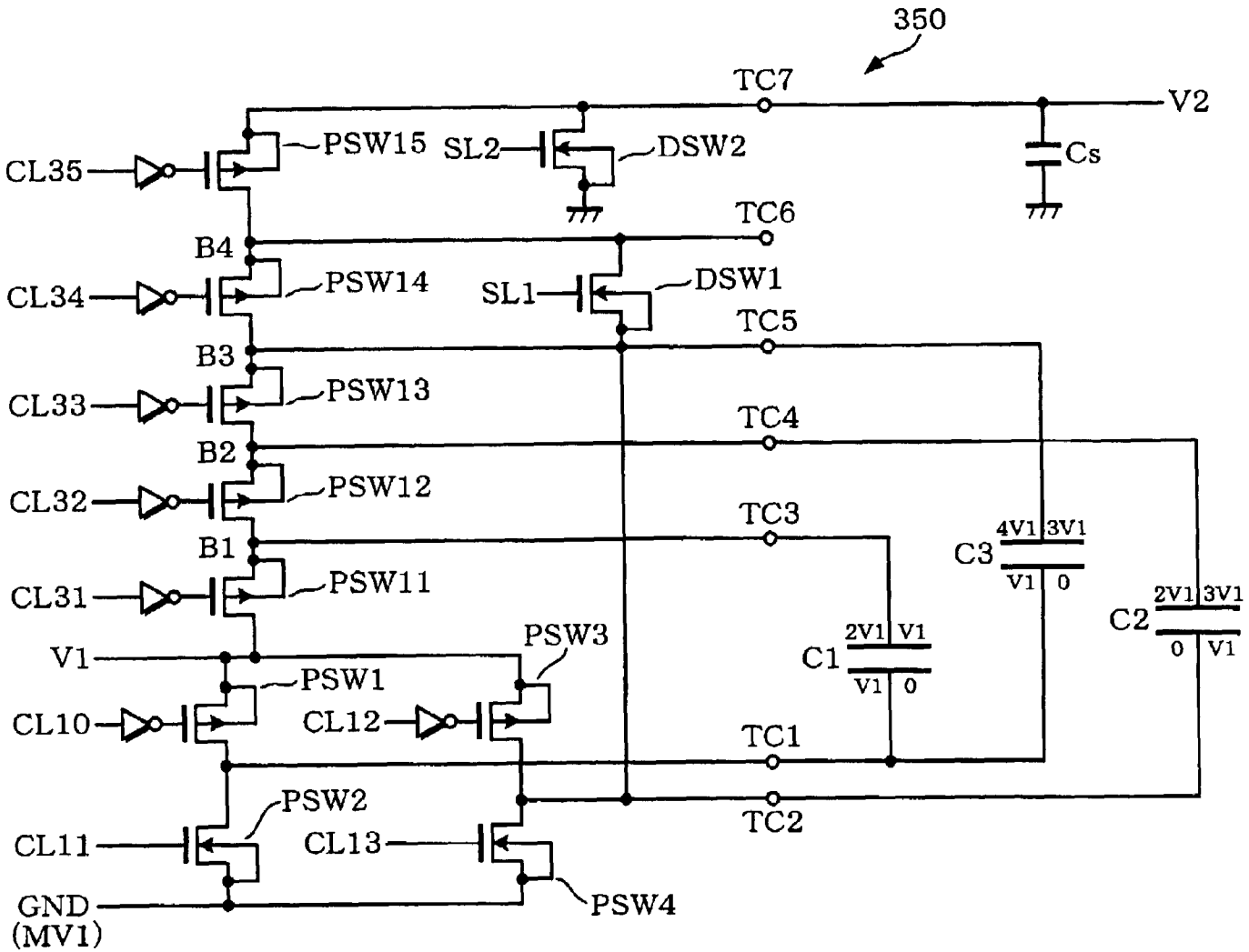
FIG. 18 is a circuit diagram showing a charge-pump circuit formed in an n-type silicon substrate.

FIG. 18 is a circuit diagram showing a charge-pump circuit formed in an n-type silicon substrate.

The charge-pump circuit 350 includes a p-type MOS transistor PSW1 and an n-type MOS transistor PSW2 connected in series between the drive voltage V1 and the system ground power supply voltage GND. The charge-pump circuit 350 includes a p-type MOS transistor PSW3 and an n-type MOS transistor PSW4 connected in series between the drive voltage V1 and the system ground power supply voltage GND. A connection node of the MOS transistors PSW1 and PSW2 is connected with one end of a capacitor connected with the external connection terminal TC1. A connection node of the MOS transistors PSW3 and PSW4 is connected with one end of a capacitor connected with the external connection terminal TC2.

The charge-pump circuit 350 further includes transistors for performing the charge-pump operation, the transistors including first to Nth (N is an integer greater than one) transistors, a first voltage being supplied to one end of the first transistor and the transistors being connected in series, and a discharge transistor, the first voltage or a second voltage lower than the first voltage being supplied to one end of the discharge transistor and the other end being connected with a node connected with the (k−1)th and kth ($2 \leqq k \leqq N$, and k is an integer) transistors. FIG. 18 shows the case where k is five.

In the case of forming such MOS transistor PSW11 to PSW15 in an n-type semiconductor substrate, the MOS transistor PSW11 to PSW15 may be implemented by using a triple-well structure.

An external connection terminal TC3 is connected with a connection node of the MOS transistors PSW11 and PSW12. An external connection terminal TC4 is connected with a connection node of the MOS transistors PSW12 and PSW13. An external connection terminal TC5 is connected with a connection node of the MOS transistors PSW13 and PSW14. An external connection terminal TC6 is connected with a connection node of the MOS transistors PSW14 and PSW15. An external connection terminal TC7 is connected with a source of the MOS transistor PSW15.

The charge-pump circuit 350 may include an output discharge transistor DSW2 connected with the source of the MOS transistor PSW15. The output discharge transistor DSW2 may be implemented by an n-type MOS transistor.

A capacitor C1 is externally connected between the external connection terminals TC1 and TC3. A capacitor C2 is externally connected between the external connection terminals TC2 and TC4. A capacitor C3 is externally connected between the external connection terminals TC1 and TC5. A stabilization capacitor Cs is externally connected between the external connection terminal TC7 and the system ground power supply voltage GND.

The charge-pump circuit 350 having such a configuration performs the charge-pump operation in synchronization with two-phase charge clock signals in the same manner as shown in FIG. 11. Therefore, description of the charge-pump operation is omitted.

Since the triple-well structure is used in the same manner as in the charge-pump circuit 200, parasitic bipolar transistor elements are formed.

Figure 19:
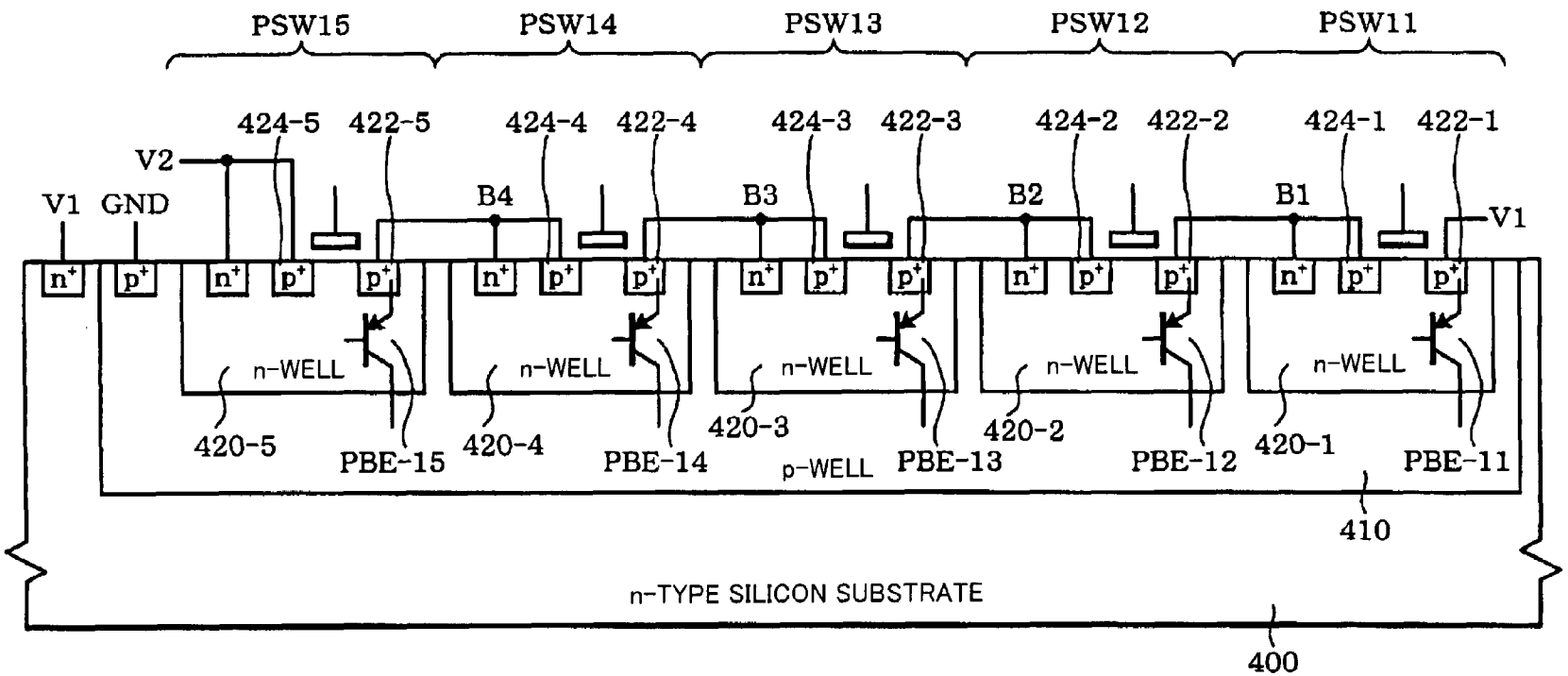
FIG. 19 is a cross-sectional view showing the MOS transistors of FIG. 18 formed in an n-type semiconductor substrate.

FIG. 19 is a cross-sectional view showing the MOS transistors PSW11 to PSW15 formed in an n-type semiconductor substrate. In FIGS. 18 and 19, the same components are denoted by the same reference numbers.

A p-well 410 (p-type well region) is formed in an n-type silicon substrate 400. First to fifth n-wells 420-1 to 420-5 (n-type first to fifth well regions) are formed in the p-well 410. The MOS transistors PSW11 to PSW15 are formed in the first to fifth n-wells 420-1 to 420-5.

The drive voltage V1 is supplied to the n-type silicon substrate 400 through an $n^+$ region. A reverse bias voltage is supplied to the p-well 410 through a $p^+$ region for a reverse bias to the first to fifth n-wells. It is preferable that the reverse bias voltage be the lowest voltage used in the power supply circuit 100 in order to prevent latchup. For example, the drive voltage MV2 or the system ground power supply voltage GND shown in FIG. 4 may be used as the reverse bias voltage. In this case, the reverse bias voltage may be referred to as the low-potential-side voltage of the high-potential-side voltage and the low-potential-side voltage applied to the scan electrode of the liquid crystal panel 520. Since the drive voltage MV2 is generated based on the drive voltage V2, the reverse bias voltage may be referred to as a voltage generated based on the boost voltage.

In FIG. 19, the first to fifth n-wells 420-1 to 420-5 are formed in the p-well 410. However, the present invention is not limited thereto. The first to fifth n-wells 420-1 to 420-5 may be respectively formed in p-wells separated from one another. However, the reverse bias voltage is respectively applied the separated p-wells.

p-type source regions 424-1 to 424-5 and drain regions 422-1 to 422-5 are respectively formed in the well regions formed by the first to fifth n-wells 420-1 to 420-5.

A gate electrode of the MOS transistor PSW11 (first transistor) is provided on a channel region between the source region 424-1 and the drain region 422-1 through an insulating film. A gate electrode of the MOS transistor PSW12 (second transistor) is provided on a channel region between the source region 424-2 and the drain region 422-2 through an insulating film. A gate electrode of the MOS transistor PSW13 (third transistor) is provided on a channel region between the source region 424-3 and the drain region 422-3 through an insulating film. A gate electrode of the MOS transistor PSW14 (fourth transistor) is provided on a channel region between the source region 424-4 and the drain region 422-4 through an insulating film. A gate electrode of the MOS transistor PSW15 (fifth transistor) is provided on a channel region between the source region 424-5 and the drain region 422-5 through an insulating film.

The drive voltage V1 is supplied to the drain region 422-1 of the first n-well 420-1. The source region 424-(m−1) of the (m−1)th (2≦m≦5, m is an integer) n-well 420-(m−1) is electrically connected with the drain region 422-m of the mth n-well 420-m, and the voltage of the source region 424-5 of the fifth n-well 420-5 is output as the drive voltage V2.

In FIG. 19, a pnp-type first parasitic bipolar transistor element PBE-11 having the first n-well 420-1 as a base region, the p-well 410 as a collector region, and the drain region 422-1 as an emitter region is formed. A pnp-type second parasitic bipolar transistor element PBE-12 having the second n-well 420-2 as a base region, the p-well 410 as a collector region, and the drain region 422-2 as an emitter region is formed. A pnp-type third parasitic bipolar transistor element PBE-13 having the third n-well 420-3 as a base region, the p-well 410 as a collector region, and the drain region 422-3 as an emitter region is formed. A pnp-type fourth parasitic bipolar transistor element PBE-14 having the fourth n-well 420-4 as a base region, the p-well 410 as a collector region, and the drain region 422-4 as an emitter region is formed. A pnp-type fifth parasitic bipolar transistor element PBE-15 having the fifth n-well 420-5 as a base region, the p-well 410 as a collector region, and the drain region 422-5 as an emitter region is formed.

In the charge-pump circuit 350, the MOS transistor PSW15 is made conductive and the discharge transistor DSW1 and the output discharge transistor DSW2 are made nonconductive in the normal operation.

In the discharge operation for discharging an electric charge stored in the capacitor of the charge-pump circuit 350 when removing electric power, the MOS transistor PSW15 is made nonconductive and the discharge transistor DSW1 and the output discharge transistor DSW2 are made conductive.

Therefore, the voltage of a connection node B4 of the MOS transistors PSW14 and PSW15 is set at the system ground power supply voltage GND or the drive voltage V1 (first voltage or second voltage lower than the first voltage).

Figure 20:
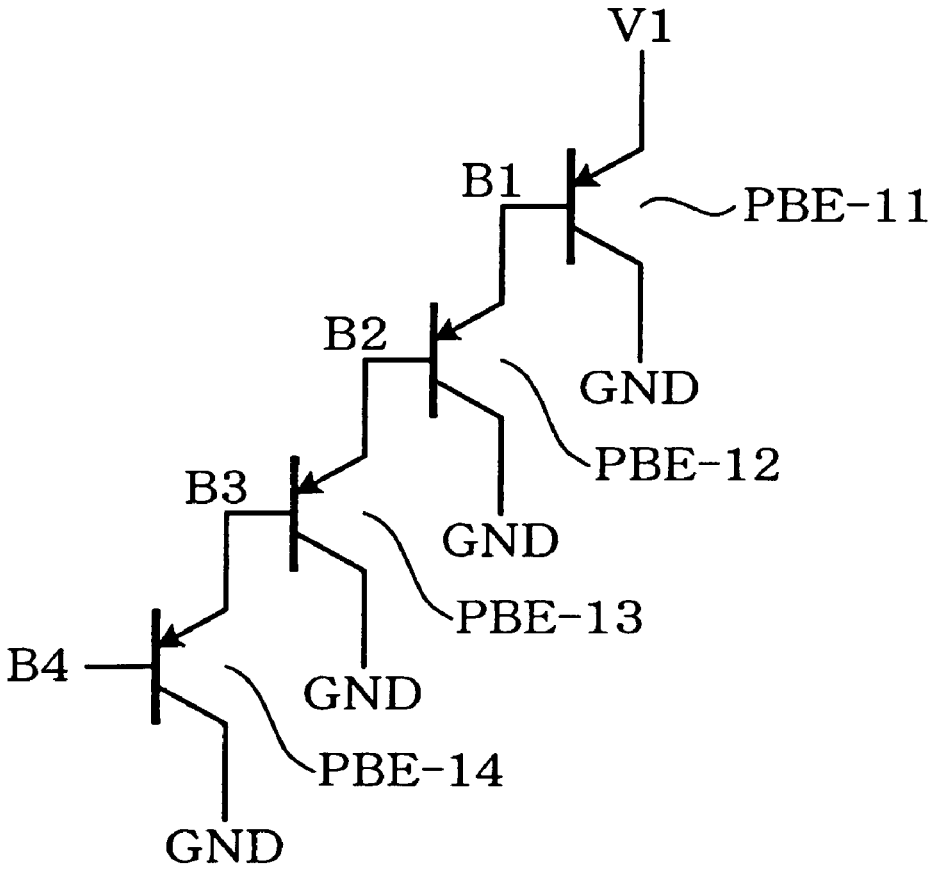
FIG. 20 shows Darlington-connected parasitic bipolar transistor elements shown in FIG. 19.

This causes the base region of the parasitic bipolar transistor element PBE-14 to be set at the system ground power supply voltage GND or the drive voltage V1. As a result, since the fourth parasitic bipolar transistor element PBE-14 is turned ON, the first to fourth parasitic bipolar transistor elements PBE-11 to PBE-14 are Darlington-connected as shown in FIG. 20, whereby a current path is formed.

Since the parasitic bipolar transistor element of the charge-pump circuit 350 is a pnp-type, the current amplification factor is small in comparison with the case where the parasitic bipolar transistor element is an npn-type. Therefore, the speed of the discharge operation is decreased in comparison with the case where npn-type parasitic bipolar transistor elements are Darlington-connected.

However, a high-speed discharge operation can also be implemented by using a simple configuration in which the number of discharge transistors is one.

Although only some embodiments of the present invention have been described in detail above, those skilled in the art will readily appreciate that many modifications are possible in the embodiments without departing from the novel teachings and advantages of this invention. Accordingly, all such modifications are intended to be included within the scope of this invention.

For example, the present invention may be applied not only to drive the liquid crystal panel, but also to drive an electroluminescent device or plasma display device.

The present invention is not limited to the configurations described in the above embodiment or modification, and various configurations equivalent to these configurations may be employed.

Part of requirements of any claim of the present invention could be omitted from a dependent claim which depends on that claim. Moreover, part of requirements of any independent claim of the present invention could be made to depend on any other independent claim.

What is claimed is:

1. A voltage booster circuit which uses an electric charge stored in a capacitor by a charge-pump operation to generate a boost voltage, the voltage booster circuit comprising:

first to Nth transistors (N is an integer greater than one) which are connected in series and used for the charge-pump operation, a first voltage being supplied to one end of the first transistor; and a discharge transistor having one end connected to a node which is connected to (k−1)th and kth transistors among the first to Nth transistors (2≦k≦N, and k is an integer), the first voltage or a second voltage which is higher than the first voltage being supplied to the other end of the discharge transistor, wherein the first to Nth transistors are respectively formed in p-type first to Nth well regions provided in an n-type well region of a p-type semiconductor substrate;

wherein a reverse bias voltage for the p-type first to Nth well regions is applied to the n-type well region;

wherein each of the p-type first to Nth well regions includes an n-type source region and an n-type drain region;

wherein a gate electrode of each of the p-type first to Nth transistors is disposed in a channel region with an insulating film interposed, the channel region being disposed between the n-type source region and the n-type drain region;

wherein the first voltage is supplied to the n-type drain region of the p-type first well region, the n-type source region of a p-type (m−1)th well region among the p-type first to Nth well regions (2≦m≦N, and m is an integer) is electrically connected to the n-type drain region of the p-type mth well region, and a voltage of the n-type source region of the p-type Nth well region is output as the boost voltage;

wherein, when a normal operation is performed, the kth to Nth transistors are made conductive, the discharge transistor is made nonconductive and the boost voltage is generated by the charge-pump operation using the first to (k−1)th transistors; and wherein, when a discharge operation is performed, the kth to Nth transistors are made nonconductive, the discharge transistor is made conductive and a current path is formed by first to (k−1)th parasitic bipolar transistor elements, the first to (k−1)th parasitic bipolar transistor elements being respectively formed by one of the p-type first to (k−1)th well regions, the n-type drain region of one of the p-type first to (k−1)th well regions, and the n-type well region.

2. The voltage booster circuit as defined in claim 1, wherein the first transistor has one end to which the first voltage is supplied, and applies the first voltage to one end of a first capacitor in a first period, the other end of the first capacitor having the second voltage in the first period and having the first voltage in a second period;

wherein the ith transistor ($2 \leqq i \leqq N$, N is an integer greater than two and i is an even number) has one end connected to one end of an (i−1)th transistor, and connects one end of an ith capacitor to one end of an (i−1)th capacitor in the second period, the other end of the ith capacitor having the first voltage in the first period and having the second voltage in the second period; and wherein the jth transistor ($3 \leqq j \leqq N$, and j is an odd number) has one end connected to one end of a (j−1)th transistor, and connects one end of a jth capacitor to one end of the (j−1)th capacitor in the first period, the other end of the jth capacitor having the second voltage in the first period and having the first voltage in the second period.

3. The voltage booster circuit as defined in claim 1, wherein the reverse bias voltage is the highest voltage used in the voltage booster circuit.

4. A voltage booster circuit which uses an electric charge stored in a capacitor by a charge-pump operation to generate a boost voltage, the voltage booster circuit comprising:

first to Nth transistors (N is an integer greater than one) which are connected in series and used for the charge-pump operation, a first voltage being supplied to one end of the first transistor; and a discharge transistor having one end connected to a node which is connected to (k−1)th and kth transistors among the first to Nth transistors ($2 \leqq k \leqq N$, and k is an integer), the first voltage or a second voltage which is lower than the first voltage being supplied to the other end of the discharge transistor, wherein the first to Nth transistors are respectively formed in n-type first to Nth well regions provided in a p-type well region of an n-type semiconductor substrate;

wherein a reverse bias voltage for the n-type first to Nth well regions is applied to the p-type well region;

wherein each of the n-type first to Nth well regions includes a p-type source region and a p-type drain region;

wherein a gate electrode of each of the n-type first to Nth transistors is disposed in a channel region with an insulating film interposed, the channel region being disposed between the p-type source region and the p-type drain region;

wherein the first voltage is supplied to the p-type drain region of the n-type first well region, the p-type source region of an n-type (m−1)th well region among the n-type first to Nth well regions ($2 \leqq m \leqq N$, and m is an integer) is electrically connected to the p-type drain region of the n-type mth well region, and a voltage of the p-type source region of the n-type Nth well region is output as the boost voltage;

wherein, when a normal operation is performed, the kth to Nth transistors are made conductive, the discharge transistor is made nonconductive and the boost voltage is generated by the charge-pump operation using the first to (k−1)th transistors; and wherein, when a discharge operation is performed, the kth to Nth transistors are made nonconductive, the discharge transistor is made conductive and a current path is formed by first to (k−1)th parasitic bipolar transistor elements, the first to (k−1)th parasitic bipolar transistor elements being respectively formed by one of the n-type first to (k−1)th well regions, the p-type drain region of one of the n-type first to (k−1)th well regions, and the p-type well region.

5. The voltage booster circuit as defined in claim 1, wherein k is N.

6. The voltage booster circuit as defined in claim 4, wherein k is N.

7. The voltage booster circuit as defined in claim 1, further comprising:

an output discharge transistor provided between the Nth well region and the first or second voltage, wherein, when the normal operation is performed, the output discharge transistor is made nonconductive; and wherein, when the discharge operation is performed, the output discharge transistor is made conductive.

8. The voltage booster circuit as defined in claim 4, further comprising:

an output discharge transistor provided between the Nth well region and the first or second voltage, wherein, when the normal operation is performed, the output discharge transistor is made nonconductive; and wherein, when the discharge operation is performed, the output discharge transistor is made conductive.

9. A power supply circuit, comprising:

the voltage booster circuit as defined in claim 1; and a voltage polarity reversal circuit which reverses the polarity of the boost voltage based on a voltage between the first voltage and the second voltage.

10. A power supply circuit, comprising:

the voltage booster circuit as defined in claim 4; and a voltage polarity reversal circuit which reverses the polarity of the boost voltage based on a voltage between the first voltage and the second voltage.

11. The power supply circuit as defined in claim 9, wherein the first voltage is one of voltages applied to a segment electrode of a simple matrix liquid crystal panel;

wherein the reverse bias voltage is one of a high-potential-side voltage and a low-potential-side voltage applied to a common electrode of the simple matrix liquid crystal panel; and wherein the boost voltage is the other of the high-potential-side voltage and the low-potential-side voltage.

12. The power supply circuit as defined in claim 10, wherein the first voltage is one of voltages applied to a segment electrode of a simple matrix liquid crystal panel;

wherein the reverse bias voltage is one of a high-potential-side voltage and a low-potential-side voltage applied to a common electrode of the simple matrix liquid crystal panel; and wherein the boost voltage is the other of the high-potential-side voltage and the low-potential-side voltage.

13. A liquid crystal driver, comprising:

the power supply circuit as defined in claim 9; and a driver circuit which drives a segment electrode or a common electrode of a simple matrix liquid crystal panel by using at least one of the first voltage, the reverse bias voltage and the boost voltage.

14. A liquid crystal driver, comprising:

the power supply circuit as defined in claim 10; and a driver circuit which drives a segment electrode or a common electrode of a simple matrix liquid crystal panel by using at least one of the first voltage, the reverse bias voltage and the boost voltage.

15. A liquid crystal driver, comprising:

the power supply circuit as defined in claim 11; and a driver circuit which drives a segment electrode or a common electrode of a simple matrix liquid crystal panel by using at least one of the first voltage, the reverse bias voltage and the boost voltage.

16. A liquid crystal driver, comprising:

the power supply circuit as defined in claim 12; and a driver circuit which drives a segment electrode or a common electrode of a simple matrix liquid crystal panel by using at least one of the first voltage, the reverse bias voltage and the boost voltage.

* * * * *